US005945788A

United States Patent [19]

Li et al.

[11] Patent Number: 5,945,788

[45] Date of Patent: Aug. 31, 1999

[54] ELECTRONIC BALLAST WITH INVERTER CONTROL CIRCUIT

[75] Inventors: Edward Li, Roselle; Guang Liu, Lake Zurich; Anand K. Upadhyay, Libertyville; Dennis L. Stephens, Barrington, all of Ill.

[73] Assignee: Motorola Inc., Schaumburg, Ill.

[21] Appl. No.: 09/050,829

[22] Filed: Mar. 30, 1998

[51] Int. Cl.[6] ..... G05F 1/00

[52] U.S. Cl. ..... 315/308; 315/291; 315/224; 315/127; 315/DIG. 5; 315/DIG. 7

[58] Field of Search ..... 315/308, 307, 315/224, 225, 209 R, 291, 293, 312, 314, 316, 324, 360, 362, DIG. 4, DIG. 7, 127, 244

[56] References Cited

U.S. PATENT DOCUMENTS

| | | | |
|---|---|---|---|
| 4,245,177 | 1/1981 | Schmitz | 315/205 |
| 4,477,748 | 10/1984 | Grubbs | 315/306 |
| 5,289,083 | 2/1994 | Quazi | 315/224 |
| 5,355,055 | 10/1994 | Tary | 315/209 R |
| 5,404,083 | 4/1995 | Nilssen | 315/244 |
| 5,449,980 | 9/1995 | Kiefer et al. | 315/240 |
| 5,463,284 | 10/1995 | Mattas | 315/240 |
| 5,500,576 | 3/1996 | Russell et al. | 315/307 |
| 5,519,289 | 5/1996 | Katyl et al. | 315/224 |
| 5,559,395 | 9/1996 | Venkitasubrahmanian et al. | 315/247 |
| 5,635,799 | 6/1997 | Hesterman | 315/127 |
| 5,650,694 | 7/1997 | Jayaraman et al. | 315/225 |
| 5,656,891 | 8/1997 | Luger et al. | 315/94 |
| 5,691,605 | 11/1997 | Xia et al. | 315/307 |
| 5,770,925 | 6/1998 | Konopka et al. | 315/225 |
| 5,883,473 | 3/1999 | Li et al. | 315/225 |

*Primary Examiner*—Haissa Philogene
*Attorney, Agent, or Firm*—Kenneth D. Labudda

[57] ABSTRACT

An electronic ballast (300) for powering at least one gas discharge lamp (10) includes an inverter (400), an output circuit (700), a lamp fault detection circuit (800), and an inverter control circuit (500). Ballast (300) operates according to an inverter control method (100) that includes repeating a filament preheating step and a frequency shifting step up to a predetermined number of times in order to facilitate lamp ignition under low-temperature conditions and to verify the legitimacy of a lamp fault. Inverter control circuit (500) is well-suited for implementation as a custom integrated circuit. Ballast (300) optionally includes an overcurrent detection circuit (820') with an adjustable lamp fault detection threshold that provides decreased sensitivity during lamp starting and enhanced protection after lamp ignition.

31 Claims, 8 Drawing Sheets

100

ELECTRONIC BALLAST WITH INVERTER CONTROL CIRCUIT

FIELD OF THE INVENTION

The present invention relates to the general subject of circuits for powering gas discharge lamps and, in particular, to an electronic ballast with an inverter control circuit.

BACKGROUND OF THE INVENTION

Electronic ballasts typically include an inverter that provides high frequency current for efficiently powering gas discharge lamps. Inverters are generally classified according to switching topology (e.g., half-bridge or push-pull) and the method used to control commutation of the inverter switches (e.g., driven or self-oscillating). In many types of electronic ballasts, the inverter provides a square wave output voltage. The square wave output voltage is processed by a resonant output circuit that provides high voltage for igniting the lamps and a magnitude-limited current for powering the lamps in a controlled manner.

When the lamps fail, or are removed, or begin to operate in an abnormal fashion, it is highly desirable that the inverter be shut down or shifted to a different mode of operation in order to protect the inverter and resonant output circuit from damage due to excessive voltage, current, and heat. Circuits that alter the operation of the inverter in response to lamp faults are usually referred to as inverter protection circuits.

In many existing ballasts that include inverter protection circuits, spurious electrical noise or a momentary variation in the lamp current, such as what may normally occur during the "break-in" period for a new fluorescent lamp, may be mistakenly interpreted as a lamp fault condition. Consequently, the inverter may be unnecessarily shut down or shifted to a different mode of operation. This poses a significant inconvenience to users and encourages wasteful replacement of functional lamps.

Additionally, many existing ballasts include no provision for ignition of lamps under low-temperature conditions at which the lamps may not properly ignite on the first attempt. In such ballasts, failure of the lamps to ignite on the first attempt is treated as a lamp fault condition. Several existing ballasts address this problem by employing "flasher" type protection circuits that periodically attempt to ignite the lamps. Flasher type circuits provide an indefinite number of ignition attempts and are therefore potentially useful for low-temperature starting. Unfortunately, flasher type protection circuits often produce sustained repetitive flashing in one or more lamps, a characteristic that has proven to be an annoyance to users/occupants.

Another problem common to many existing ballasts with inverter protection circuits relates to fault detection sensitivity. Ideally, a protection circuit should tolerate a certain amount of erratic behavior during lamp ignition without treating such behavior as a lamp fault condition, but should be considerably more sensitive during normal operation after the lamp has ignited. Many existing ballasts utilize the same lamp fault detection threshold during ignition and normal operation. In such circuits, in order to avoid false detection during lamp ignition, the fault detection threshold must be set somewhat high. Unfortunately, a high fault detection threshold has the unfavorable effect of precluding or interfering with the detection of legitimate lamp faults during normal operation, and may therefore limit the ability of the protection circuit to fulfill its intended purpose of preventing damage to the inverter and output circuit.

Many existing protection circuits require a large number of discrete components. This makes the ballast physically large, materially expensive, and difficult to manufacture. From the standpoint of reliability and manufacturability, it is highly desirable to have a ballast that requires only a modest amount of discrete lamp fault detection circuitry and that incorporates the greater portion of the protection logic and circuitry in an inverter control circuit that is well-suited for implementation as an integrated circuit.

It is therefore apparent that a need exists for an electronic ballast with an inverter control method and inverter control circuit that offers enhanced immunity to electrical noise and normal transient variations in lamp current, and that provides multiple ignition attempts for igniting lamps under low-temperature conditions, but that does not produce sustained flashing of the lamps. A need also exists for an electronic ballast with an inverter control method and inverter control circuit that includes an adjustable lamp fault detection threshold for decreased sensitivity during lamp starting and enhanced protection during lamp operation. A further need exists for an electronic ballast with an inverter control circuit that minimizes the required amount of discrete lamp fault detection circuitry and that is well-suited for implementation as a single integrated circuit. Such a ballast would offer improved operation, enhanced reliability, and greater ease of manufacture, and would therefore represent a significant improvement over the prior art.

DETAILED DESCRIPTION OF THE PREFERRED EMBODIMENTS

Figure 1A:
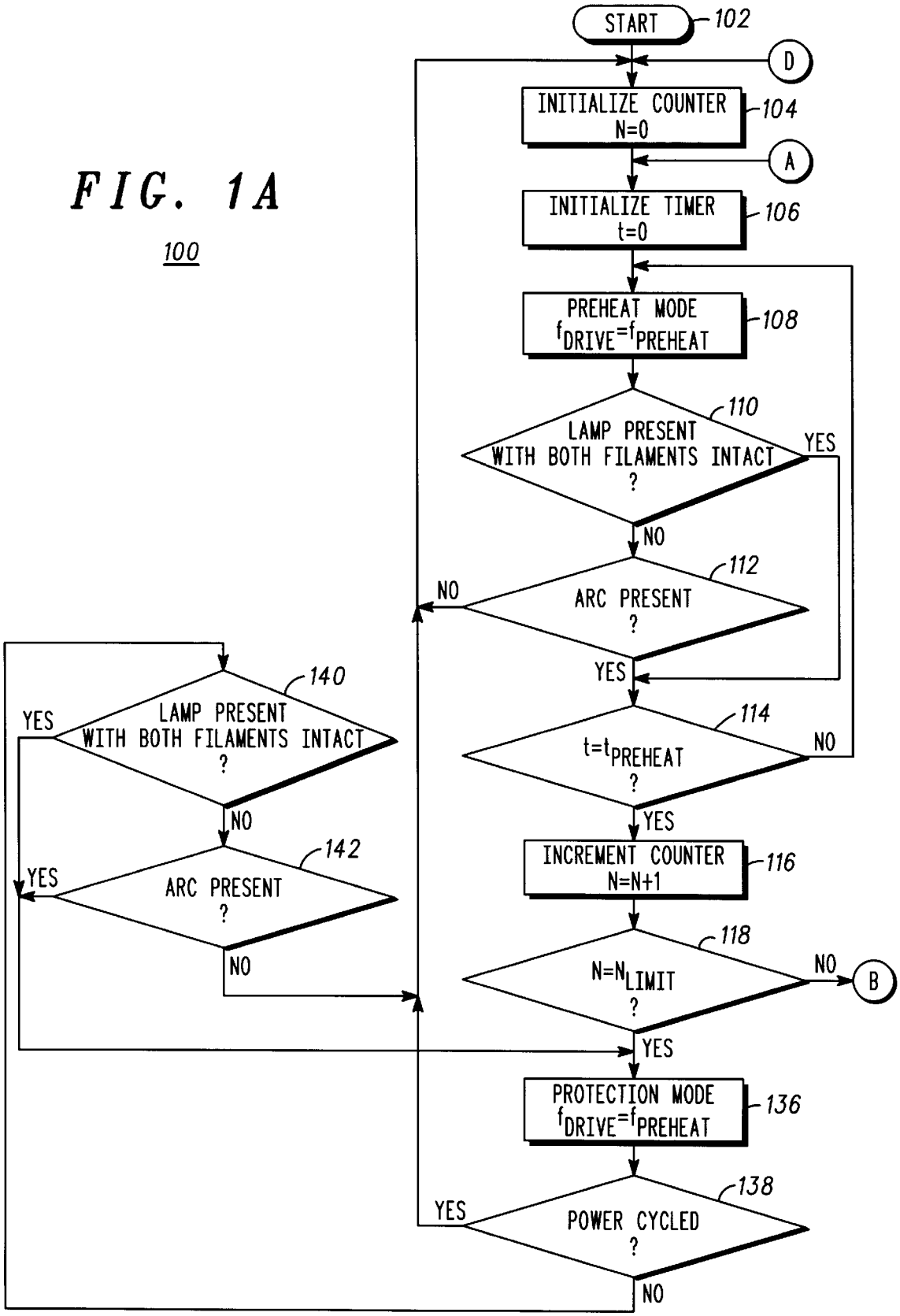
FIG. 1 is a flowchart that describes an inverter control method, in accordance with a preferred embodiment of the present invention.
Figure 1B:
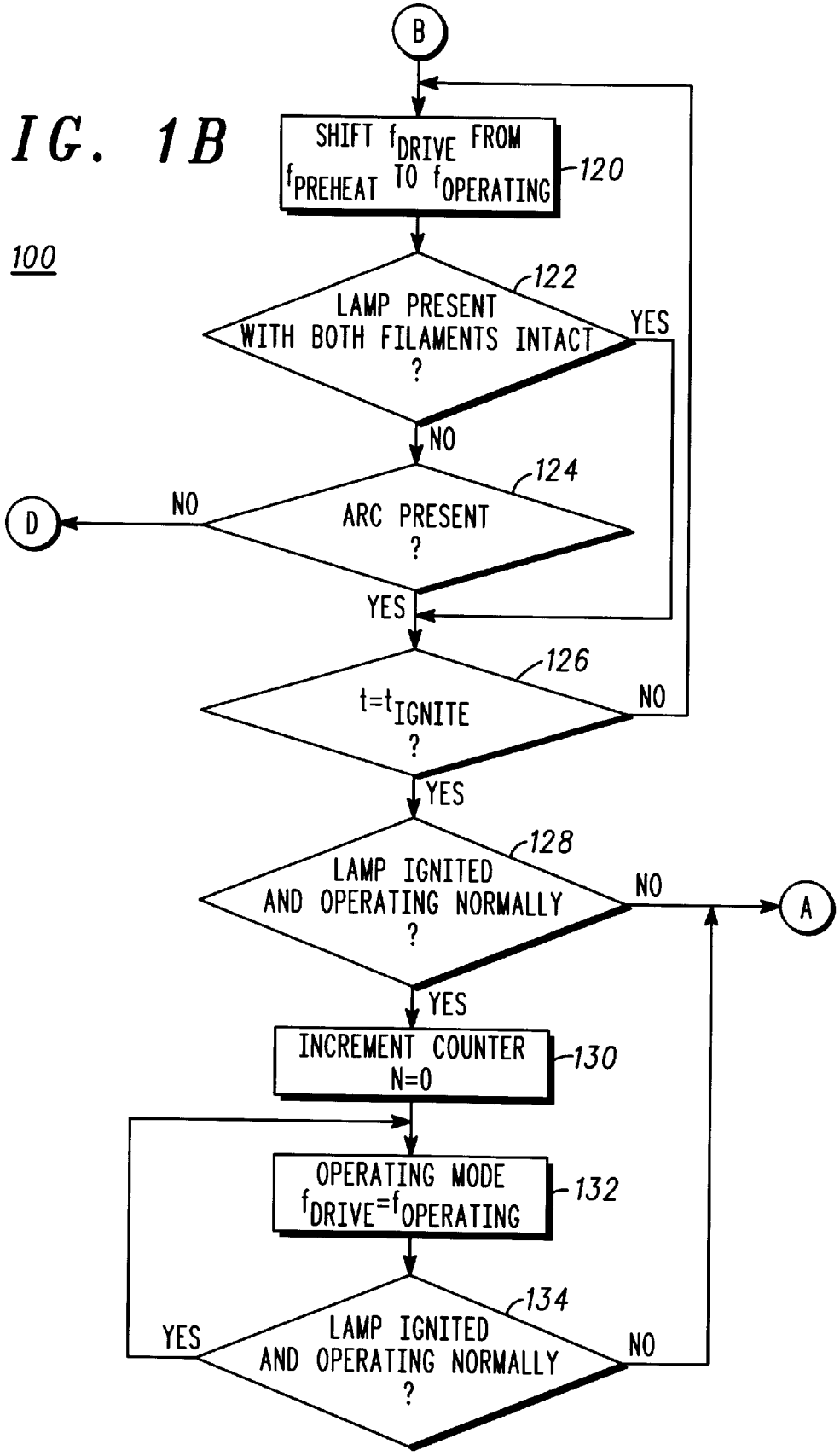

FIG. 1 describes a method 100 of controlling an inverter in an electronic ballast for powering at least one gas discharge lamp. The gas discharge lamp has a pair of filaments and the inverter is operable to drive a resonant output circuit at a drive frequency, $f_{DRIVE}$. Method 100 includes the following steps:

(1) Preheating the lamp filaments by setting the drive frequency, $f_{DRIVE}$, at a preheat frequency, $f_{PREHEAT}$, for a predetermined preheating period, $0<t\leqq t_{PREHEAT}$;

(2) Shifting $f_{DRIVE}$ from $f_{PREHEAT}$ to an operating frequency, $f_{OPERATING}$;

(3) Powering the lamp by maintaining $f_{DRIVE}$ at $f_{OPERATING}$ if both of the following conditions are true : (i) the lamp ignites and operates normally within a predetermined ignition period, $t_{PREHEAT}<t\leqq t_{IGNITE}$; and (ii) the lamp continues to operate normally after igniting;

(4) Repeating Steps 1 and 2 up to a predetermined number of times, $N_{REPEAT}$, in response to each of the following conditions: (i) failure of the lamp to ignite and operate normally within the ignition period when both filaments are intact and properly connected to the ballast; and (ii) failure of the lamp to continue to operate normally after igniting;

(5) Protecting the inverter by setting $f_{DRIVE}$ to $f_{PREHEAT}$ in response to each of the following conditions: (i) removal of the lamp; and (ii) failure of the lamp to ignite and operate normally within the ignition period after Step 4 has been carried out $N_{REPEAT}$ times.

For purposes of the present description, the lamp can be considered to be "operating normally" when it is conducting current in a substantially periodic, symmetrical manner and with a fairly stable peak value. The two most common departures from normal operation are commonly referred to as "degassed lamp" and "diode-mode lamp". When a lamp becomes degassed, it loses its ability to sustain a discharge and thus conducts essentially zero arc current. A diode-mode lamp conducts arc current in a somewhat erratic and typically asymmetrical manner, and may persist in operating in this manner for a considerable period of time prior to failing if power is continuously supplied to the lamp by the ballast.

In a preferred embodiment of method 100, Step 5 includes maintaining $f_{DRIVE}$ at $f_{PREHEAT}$ until at least such time as the lamp is replaced or the power applied to the ballast is removed. The inverter preferably includes a counter having a count, N, and method 100 further includes the step of initializing the counter (i.e., setting N=0) in response to each of the following conditions: (i) initial application of power to the ballast; (ii) cycling (i.e., removing and then reapplying) of the power applied to the ballast; (iii) disconnection of the lamp from the ballast; and (iv) ignition and normal operation of the lamp within the ignition period. Preferably, method 100 further includes the steps of incrementing the count by one (i.e., N=N+1) upon completion of filament preheating, and determining if the count has reached a predetermined count limit, $N_{LIMIT}$. In response to N reaching $N_{LIMIT}$, the step of protecting the inverter (Step 5) is then carried out. For convenience, $N_{LIMIT}$ is preferably chosen to be equal to an integer multiple of two, such as 4, 8, 16, 32, etc., since these values allow the counter to be readily implemented using available digital counter circuits.

In a preferred embodiment of method 100, the inverter includes a timer, and method 100 further includes the step of initializing the timer (i.e., setting t=0) in response to each of the following conditions: (i) initial application of power to the ballast; (ii) cycling of the power applied to the ballast; (iii) disconnection of the lamp from the ballast; (iv) failure of the lamp to ignite and operate normally within the ignition period; and (v) failure of the lamp to continue to operate normally after igniting.

In order to develop a high voltage for igniting the lamp, as well as to provide power to the lamp in an energy efficient manner, the operating frequency, $f_{OPERATING}$, is chosen to be reasonably close to the natural resonant frequency, $f_{RESONANT}$, of the resonant output circuit. Further, in order to preclude premature ignition of the lamp during filament preheating and to minimize power dissipation in the ballast when protecting the inverter (i.e., Step 5), the preheat frequency, $f_{PREHEAT}$, is chosen to be substantially greater than $f_{RESONANT}$. As an example, in a prototype ballast with $f_{RESONANT}$=39 kHz, $f_{OPERATING}$ and $f_{PREHEAT}$ were chosen to be approximately 43 kHz and 73 kHz, respectively.

For purposes of igniting a common gas discharge lamp, such as a linear T8 fluorescent lamp, the predetermined preheating period, $0<t\leqq t_{PREHEAT}$, is preferably chosen to be between about 500 milliseconds and about 1 second. The ignition period, $t_{PREHEAT}<t\leqq t_{IGNITE}$, preferably ranges between about 50 milliseconds and about 200 milliseconds. Proper choices for the preheating and ignition periods are dependent upon several factors, such as lamp type and the range of environmental temperatures over which the ballast must reliably ignite a functional lamp.

A preferred embodiment of method 100 is now described in detail with reference to FIG. 1 as follows. The inverter starts (102) after power is applied to the ballast. Once the inverter starts, the counter and timer are initialized (104, 106), and the inverter is operated at $f_{DRIVE}=f_{PREHEAT}$ (108). Decision step 110 tests whether or not the lamp filaments are intact and properly connected to the ballast. If so, the inverter continues to operate at $f_{DRIVE}=f_{PREHEAT}$ until $t=t_{PREHEAT}$. If both filaments are not intact or are not properly connected to the ballast, decision step 112 tests whether or not the lamp is at least conducting arc current. When the filaments are preheating for the first time following initial application of power to the ballast, decision step 112 is largely irrelevant since the lamp has obviously not yet ignited. However, as will be discussed below, decision step 112 becomes relevant if the preheating process is later repeated while the lamp is ignited.

If both filaments are not intact or are not properly connected to the ballast, and the lamp is not conducting, the counter and timer are reset (104,106) and the inverter continues to operate at $f_{DRIVE}=f_{PREHEAT}$ until at least such time as a lamp with intact filaments is properly connected to the ballast.

If both lamp filaments are intact and are properly connected to the ballast, once $t=t_{PREHEAT}$ (114) the count is incremented by one (116) and is compared to $N_{LIMIT}$ (118). If the count is less than $N_{LIMIT}$, the shifting process (120, . . . ) follows. On the other hand, if the count equals $N_{LIMIT}$, indicating that the predetermined number of attempts have already been made to preheat the filaments and ignite the lamp, the ballast enters the protection mode (136, . . . ). In the protection mode, $f_{DRIVE}$ remains at $f_{PREHEAT}$ if power remains continuously applied to the ballast (138) and either the lamp remains present with both filaments intact (140) or the lamp continues to conduct arc current (142). Note that, once in the protection mode, the ballast will remain the protection mode until at least such time as: (i) the power to the ballast is removed (138); or (ii) the lamp is removed (140,142); or (iii) the lamp fails to conduct arc current and has at least one open or disconnected filament (140,142). Any of these three conditions will lead to a repeat of the initialization (104,106) and preheating (108, . . . ) processes. Since lamp removal returns the ballast to the preheating mode (108, . . . ), method 100 automatically provides, in response to replacement of the lamp (i.e., "relamping") full filament preheating prior to attempting to ignite the lamp.

Following completion of filament preheating (108, . . . ) and incrementation of the counter (116), if the count is less than $N_{LIMIT}$ (118), the shifting process (120, . . . ) is then performed. During the shifting process, a high voltage is generated by shifting $f_{DRIVE}$ from $f_{PREHEAT}$ down to $f_{OPERATING}$ (118). Preferably, the shifting of $f_{DRIVE}$ from $f_{PREHEAT}$ to $f_{OPERATING}$ does not occur instantaneously, but is a transition that requires a finite amount of time (e.g., around 50 milliseconds) to complete. If $f_{OPERATING}$ is chosen to be reasonably close to $f_{RESONANT}$, then at some point prior to $f_{DRIVE}$ actually reaching $f_{OPERATING}$, the resonant output circuit will develop a voltage that is high enough to ignite a "good" (i.e., functional) lamp. If the lamp fails to ignite and begin operating normally by $t=t_{IGNITE}$ (126), it is concluded that something is wrong and the preheating process (108, . . . ) is repeated, but without reinitializing the counter (104). Upon completion of preheating at $t=t_{PREHEAT}$, the count is incremented once again. If the count is still less than $N_{LIMIT}$, the shifting process (120, . . . ) is repeated as previously recited. However, if the count is now equal to $N_{LIMIT}$, the protection mode (134, . . . ) follows.

Following successful ignition of the lamp (128), the count is re-initialized (130) and $f_{DRIVE}$ is maintained at $f_{OPERATING}$ (132). During the operating mode (132, . . . ), $f_{DRIVE}$ remains at $f_{OPERATING}$ for as long as the lamp continues to operate in a fault-free manner (134).

If the lamp is removed (i.e., physically disconnected from the ballast) while the ballast is in the operating mode (132, . . . ), the ballast will enter the preheat mode (108). With the lamp removed, decision steps 110,112 are followed by re-initialization of the counter 104. Subsequently, the ballast will remain in the preheat mode (108) until at least such time as a lamp with intact filaments is connected to the ballast. The preheat mode (108) thus protects the ballast by maintaining $f_{DRIVE}=f_{PREHEAT}$, and thereby limiting the voltage, current, and power dissipation in the inverter and output circuit, when the lamp is removed.

While in the operating mode (132, . . . ), if the lamp remains present but ceases to operate normally (134), such as what occurs with a diode-mode or degassed lamp, the timer is re-initialized (106) and the preheat process (108, . . . ) is repeated. However, the counter is not re-initialized (104). By not re-initializing the counter following departure of the lamp from normal operation, method 100 keeps track of the number of preheating and ignition cycles and eventually enters the protection mode (136, . . . ) if the lamp fails to ignite and operate normally after the preheating and ignition processes have been repeated a certain number of times.

Significantly, in the case of a condition in which the lamp remains present but only momentarily fails to operate normally, method 100 does not immediately proceed to the protection mode (136, . . . ), but first attempts to verify that the perceived lamp fault is indeed a problem. Consider, for example, what occurs in the case of a one-time momentary fluctuation in the lamp current. If such a fluctuation is perceived as a departure from normal operation of the lamp (134), the filament preheating (108, . . . ) and shifting modes (120, . . . ) will be repeated, upon completion of which the lamp will proceed to operate normally (132, . . . ). A similar situation occurs in the case of a "good" lamp in a low-temperature environment. While the lamp may fail to ignite on the first attempt, additional filament preheating will most likely produce successful ignition on a subsequent attempt. The number of attempts that can be made prior to "giving up" and entering the protection mode (136, . . . ) is governed by the choice for $N_{LIMIT}$. For example, with $N_{LIMIT}=8$, the filament preheating process (108, . . . ) will be repeated up to eight times, and the shifting process (120, . . . ) up to seven times, before the ballast finally enters the protection mode.

If the lamp truly ceases to operate in a normal manner while the ballast is in the operating mode (132), such as what occurs with a diode-mode lamp, the filament preheating and ignition modes will likewise be repeated up to a limited number of times. For a diode-lamp, during each ignition attempt, the lamp may briefly light and then extinguish. However, since the lamp will almost always fail to ignite and operate normally each time (128), the counter will not be reinitialized between successive attempts. Consequently, the count will eventually reach $N_{LIMIT}$, at which point the ballast will "give up" and enter the protection mode. During the aforementioned process, a diode-mode lamp will flash on and off a number of times, and then cease to flash once the ballast enters the protection mode; a degassed lamp will not flash at all, since it is incapable of initiating an arc. Method 100 thus provides a useful degree of noise immunity by allowing the ballast to avoid entering the protection mode in response to simple electrical noise or occasional random fluctuations in the lamp current. At the same time, method 100 protects the inverter in the case of an actual lamp fault condition and avoids sustained flashing of the lamp.

While in the operating mode (132), if the lamp continues to operate normally but one or both of its filaments become open, the ballast will remain in the operating mode. This is acceptable since the lamp poses no danger to the inverter and output circuit, and may even continue to provide useful illumination for a significant period of time if power is continuously applied to the ballast. Of course, if ballast power is removed and then re-applied at some future time, the lamp will not ignite since its open filament(s) will be incapable of being properly preheated. Further, since a lamp often exhibits diode-mode behavior prior to outright failure of its filaments, it is likely that the aforementioned situation (i.e., lamp operating normally with one or both filaments failed) may never actually occur since, as previously described, the ballast would respond to the diode-mode behavior by eventually entering the protection mode (136, . . . ) prior to outright failure of the filament(s).

While in the operating mode (132, . . . ), if a lamp with at least one open filament begins to conduct arc current in an abnormal manner, the ballast will enter the preheat mode (108, . . . ). Although both filaments are not intact, the ballast will proceed with normal execution of the preheating process (108, . . . ), due to decision step 112, as long as the lamp continues to conduct at least some arc current; if the arc is extinguished, on the other hand, the counter will be re-initialized (104) and the ballast will remain in the preheat mode (108) until at least such time as the lamp is replaced.

Method 100 optionally includes the step of providing an adjustable lamp fault detection threshold for use in detecting a lamp fault condition, wherein: (i) during the ignition period, the lamp fault detection threshold, $V_{FAULT}$, is maintained at a first level, $V_1$; and (ii) after completion of the ignition period, $V_{FAULT}$ is set at a second level, $V_2$, that is lower than $V_1$. Setting $V_{FAULT}=V_1$ prior to lamp ignition provides decreased sensitivity so that the transients that normally occur in the course of lamp starting are not detected as a lamp fault condition. Decreasing $V_{FAULT}$ to $V_2$ following completion of ignition provides more sensitive detection of lamp faults, and thus enhanced protection of the inverter, during steady-state operation when the lamp is expected to conduct arc current in a reasonably well-behaved manner. Preferred circuitry for providing an adjustable lamp fault detection threshold is described in FIG. 7 and will be discussed in greater detail below.

Although thus far described with regard to operating a single gas discharge lamp, method 100 is also adaptable for use in an electronic ballast for powering two or more gas discharge lamps. More specifically, when employed in a ballast for two or more lamps, Step 3 includes maintaining $f_{DRIVE}=f_{OPERATING}$ in response to ignition and normal operation of all of the lamps within $t_{PREHEAT}<t\leqq t_{IGNITE}$, followed by continued normal operation of all of the lamps after ignition. Step 4 (i.e., repeating the steps of preheating the filaments and shifting the drive frequency) is carried out in response to each of the following conditions: (i) failure of at least one of the lamps to ignite and operate normally within the ignition period when all lamp filaments are intact and properly connected to the ballast; and (ii) failure of at least one of the lamps to continue to operate normally after igniting. Step 5 (i.e., protecting the inverter by setting $f_{DRIVE}=f_{PREHEAT}$) is carried out in response to failure of at least one of the lamps to ignite and operate normally within the ignition period after Step 4 has been carried out $N_{REPEAT}$ times.

Step 5 preferably includes maintaining $f_{DRIVE}$ at $f_{PREHEAT}$ until at least such time as all failed lamps are replaced with functional lamps, or the power applied to the ballast is removed. The inverter preferably includes a counter having a count, N, and method 100 further includes the step of initializing the counter (i.e., setting N=0) in response to each of the following conditions: (i) initial application of power to the ballast; (ii) cycling of the power applied to the ballast; (iii) disconnection of at least one lamp from the ballast; and (iv) ignition and normal operation of all of the lamps within the ignition period.

Preferably, the inverter includes a timer, and method 100 further includes the step of initializing the timer (i.e., setting t=0) in response to each of the following conditions: (i) initial application of power to the ballast; (ii) cycling of the power applied to the ballast; (iii) disconnection of at least one of the lamps from the ballast; (iv) failure of at least one of the lamps to ignite and operate normally within the ignition period; and (v) failure of at least one of the lamps to continue to operate normally after igniting.

In a ballast for powering multiple lamps, occurrence of diode-mode behavior in even a single lamp, with the remaining lamp(s) operating normally, may still pose a significant threat to the continued reliability and/or survival of the inverter. Along similar lines, while removal of only one lamp may not necessarily produce extremely high voltages and/or currents that would promptly damage or destroy the inverter and output circuit, operation in such a "reduced load" condition is nevertheless undesirable due to increased power dissipation and reduced energy efficiency.

Hence, method 100 is responsive even to fault conditions that are attributable to only a single lamp, and provides full operating power to the lamps (i.e., maintains $f_{DRIVE}=f_{OPERATING}$) only if all of the lamps ignite and operate in a normal manner.

Figure 2:
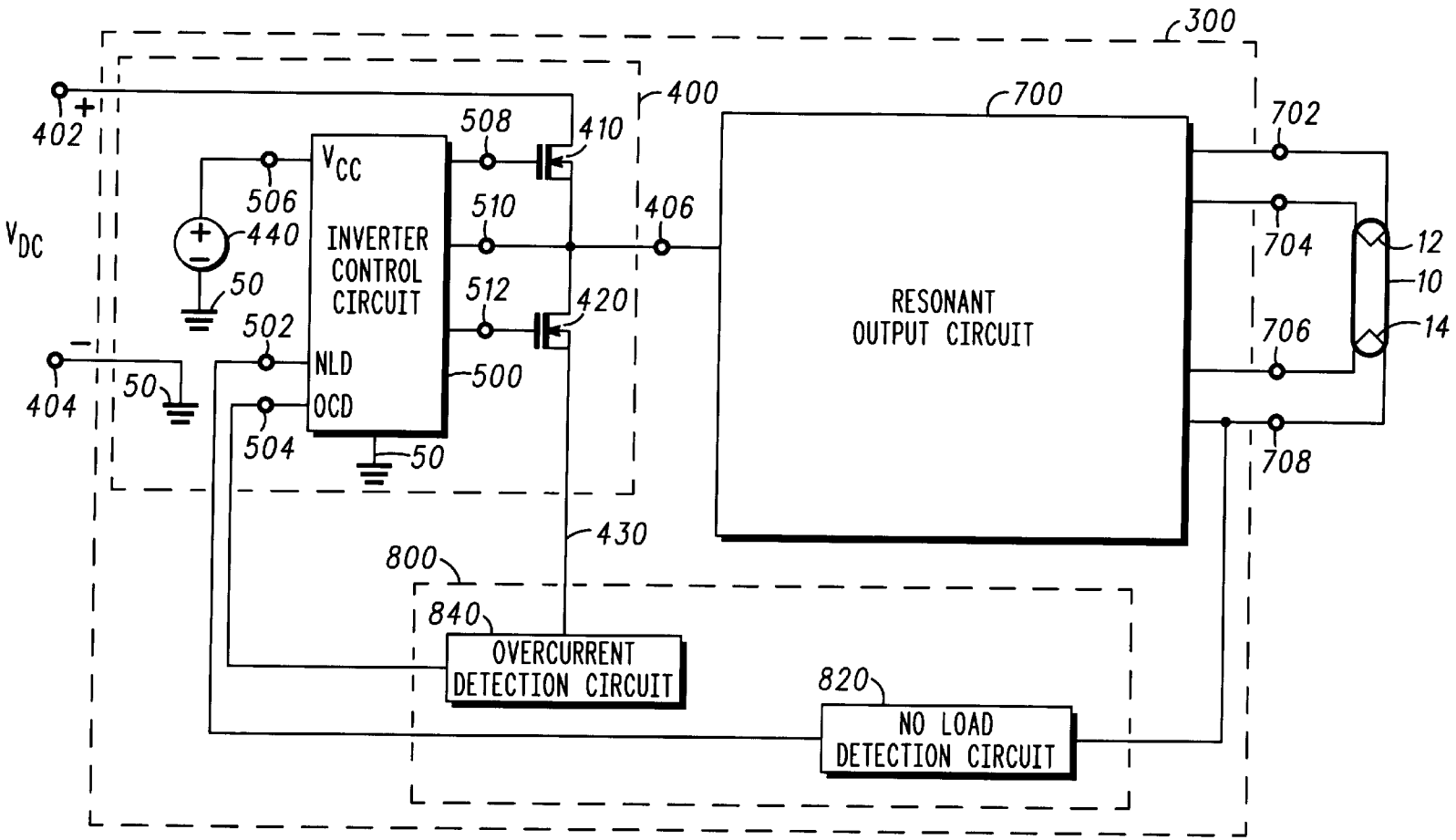
FIG. 2 is a partial schematic diagram of an electronic ballast with an inverter control circuit, in accordance with a preferred embodiment of the present invention.

An electronic ballast 300 that includes circuitry for implementing method 100 is described in FIG. 2. Electronic ballast 300 is adapted for powering at least one gas discharge lamp 10 having a pair of heatable filaments 12,14. Ballast 300 comprises an inverter 400, a resonant output circuit 700, and a lamp fault detection circuit 800.

Inverter 400 includes first and second input terminals 402,404, an inverter output terminal 406, a first inverter switch 410, a second inverter switch 420, and an inverter control circuit 500. Input terminals 402,404 are adapted to receive a source of input power, such as a substantially direct current (DC) voltage, $V_{DC}$. $V_{DC}$ is typically on the order of several hundred volts and may be provided via rectification of a standard 120 volt or 277 volt alternating current (AC) supply using any of a number of AC-to-DC converter circuits, such as a full-wave diode bridge, a boost converter, or other circuitry that is widely employed in power supplies and electronic ballasts. Second input terminal 404 is coupled to a circuit ground node 50. Circuit ground node 50 serves as a local "ground reference" for the circuitry within ballast 300. First inverter switch 410 is coupled between first input terminal 402 and inverter output terminal 406. Second inverter switch 420 is coupled between inverter output terminal 406 and a first node 430. Inverter switches 410,420 are depicted in FIG. 2 as field-effect transistors (FETs), but may alternatively be implemented using other power switching devices, such as bipolar junction transistors (BJTs). Inverter control circuit 500 is coupled to inverter switches 410,420 and is operable to commutate (i.e., switch on and off) inverter switches 410,420 at a drive frequency, $f_{DRIVE}$. More specifically, during operation, inverter control circuit 500 turns the inverter switches 410,420 on and off in a substantially complementary fashion so that when one switch is on, the other is off, and vice-versa. Inverter control circuit 500 includes a plurality of fault detection inputs 502, 504, and a DC supply input 506 for receiving operating power from a DC voltage source 440. DC voltage source 440 may be conveniently realized using any of a number of well-known "bootstrapping" circuits that are capable of providing operating power to inverter control circuit 500 after power is applied to ballast 300.

Resonant output circuit 700 is coupled to inverter output terminal 406 and includes a plurality of output wires 702, 704, 706, 708 coupleable to lamp 10. Resonant output circuit 700 has a natural resonant frequency, $F_{RESONANT}$ Resonant output circuit 700 accepts a substantially squarewave output voltage from inverter 400 and provides a high voltage for igniting lamp 10, as well as a magnitude-limited current for powering the lamp after ignition.

Lamp fault detection circuit 800 is coupled between first node 430, at least one of the output wires 702, . . . ,708, and the fault detection inputs 502,504 of inverter control circuit 500. During operation, lamp fault detection circuit 800 provides fault detection signals to the fault detection inputs 502,504 of inverter control circuit 500 to indicate whether or not a lamp fault condition is present.

Inverter control circuit 500 provides the following operating modes:

(1) a filament preheating mode wherein the drive frequency, $f_{DRIVE}$, is maintained at a preheat frequency, $f_{PREHEAT}$, for a predetermined preheating period, $0<t\leqq t_{PREHEAT}$;

(2) a frequency shifting mode in which $f_{DRIVE}$ is shifted from $f_{PREHEAT}$ to an operating frequency, $f_{OPERATING}$;

(3) a high-power operating mode in which $f_{DRIVE}$ is maintained at $f_{OPERATING}$ in response to successful ignition and normal operation of lamp 10 within a predetermined ignition period, $t_{PREHEAT}<t\leqq t_{IGNITE}$, followed by continued normal operation of lamp 10 after ignition;

(4) a repeating mode wherein the filament preheating and frequency shifting modes are repeated up to a predetermined number of times, $N_{REPEAT}$, in response to each of the following conditions:

(i) failure of the lamp to ignite and operate normally within the ignition period when both lamp filaments are intact and properly connected to the output wires;

(ii) failure of the lamp to continue to operate normally after igniting;

(5) a low-power protection mode in which $f_{DRIVE}$ is set to $f_{PREHEAT}$ in response to each of the following conditions:

(i) the lamp being removed (i.e., disconnected from the ballast; and (ii) the lamp failing to ignite and operate normally within the ignition period after the repeating mode has been carried out $N_{REPEAT}$ times.

Preferably, the low-power protection mode includes holding $f_{DRIVE}$ at $f_{PREHEAT}$ until at least such time as lamp 10 is replaced or the power applied to ballast 300 is removed. In order to generate sufficiently high voltage to ignite lamp 10, as well as to supply power to lamp 10 in an efficient manner, $f_{OPERATING}$ is chosen to be fairly close to $f_{RESONANT}$ On the other hand, in order to preclude premature ignition of lamp 10 and to prevent high power dissipation, overvoltage, and overcurrent conditions during a lamp fault condition, $f_{PREHEAT}$ is chosen to be somewhat distant from $f_{RESONANT}$. For example, in one experimental ballast configured substantially as shown in FIG. 2 and with $f_{RESONANT}$ approximately equal to 39 kilohertz (kHz), $f_{OPERATING}$ was set at 43 kHz and $f_{PREHEAT}$ was set at 73 kHz.

As described in FIG. 2, inverter control circuit 500 preferably includes a no-load detection (NLD) input 502 and an overcurrent detection (OCD) input 504. Correspondingly, lamp fault detection circuit 800 preferably comprises a no-load detection circuit 820 and an overcurrent detection circuit 840.

In general, no-load detection circuit 820 is coupled between at least one of the output wires 702, . . . ,708 and NLD input 502; as described in FIG. 2, no-load detection circuit 820 is coupled between fourth output wire 708 and NLD input 502. During operation, no-load detection circuit 820 provides a logic "1" at NLD input 502 in response to each of the following conditions: (i) both lamp filaments 12,14 being intact and properly connected to output wires 702, . . . 708; and (ii) the lamp conducting arc current. No-load detection circuit 820 provides a logic "0" at NLD input 502 in response to each of the following conditions: (i) removal of lamp 10;

and (ii) at least one of the lamp filaments 12,14 being open when lamp 10 is not conducting arc current. Thus, during normal operation with a functional lamp, a logic "1" will be provided at NLD input 502. If one or both filaments 12,14 become open while lamp 10 is operating, no-load detection circuit 820 will continue to provide a logic "1" at NLD input 502 as long as lamp 10 continues to conduct at least some arc current.

Overcurrent detection circuit 840 is coupled between first node 430 and OCD input 504. During operation, overcurrent detection circuit 840 provides a logic "0" at OCD input 504 in response to lamp 10 conducting current in a substantially normal manner when ballast 300 is in the high-power operating mode. Overcurrent detection circuit 840 provides a logic "1" at OCD input 504 in response to each of the following conditions: (i) failure of lamp 10 to ignite and operate normally within the ignition period; and (ii) failure of lamp 10 to continue to conduct current in a substantially normal manner after igniting. Furthermore, overcurrent detection circuit 840 preferably provides a logic "0" at OCD input 504 during the filament preheating and low-power protection modes, and during at least a portion of the frequency shifting mode.

According to conventional usage, "logic 0" refers to any voltage that is less than a certain value (e.g., 0.6 volts), while "logic 1" refers to any voltage that is greater than the certain value. It should be appreciated, however, that the present invention is not necessarily limited to such a "positive logic" convention. For example, the circuitry of ballast 300 may be designed according to a "negative logic" convention wherein any voltage less than, say, 2 volts is treated as a "logic 1" , while any voltage greater than 2 volts is treated as a "logic 0". Furthermore, the voltage level (e.g., 0.6 volts) that distinguishes between a logic "0" and a logic "1" may generally differ among the components and subcircuits of ballast 300, so that the range of voltage that constitutes a logic "1" for no-load detection circuit 820 may not necessarily be the same as that which constitutes a logic "1" for overcurrent detection circuit 840.

Figure 3:
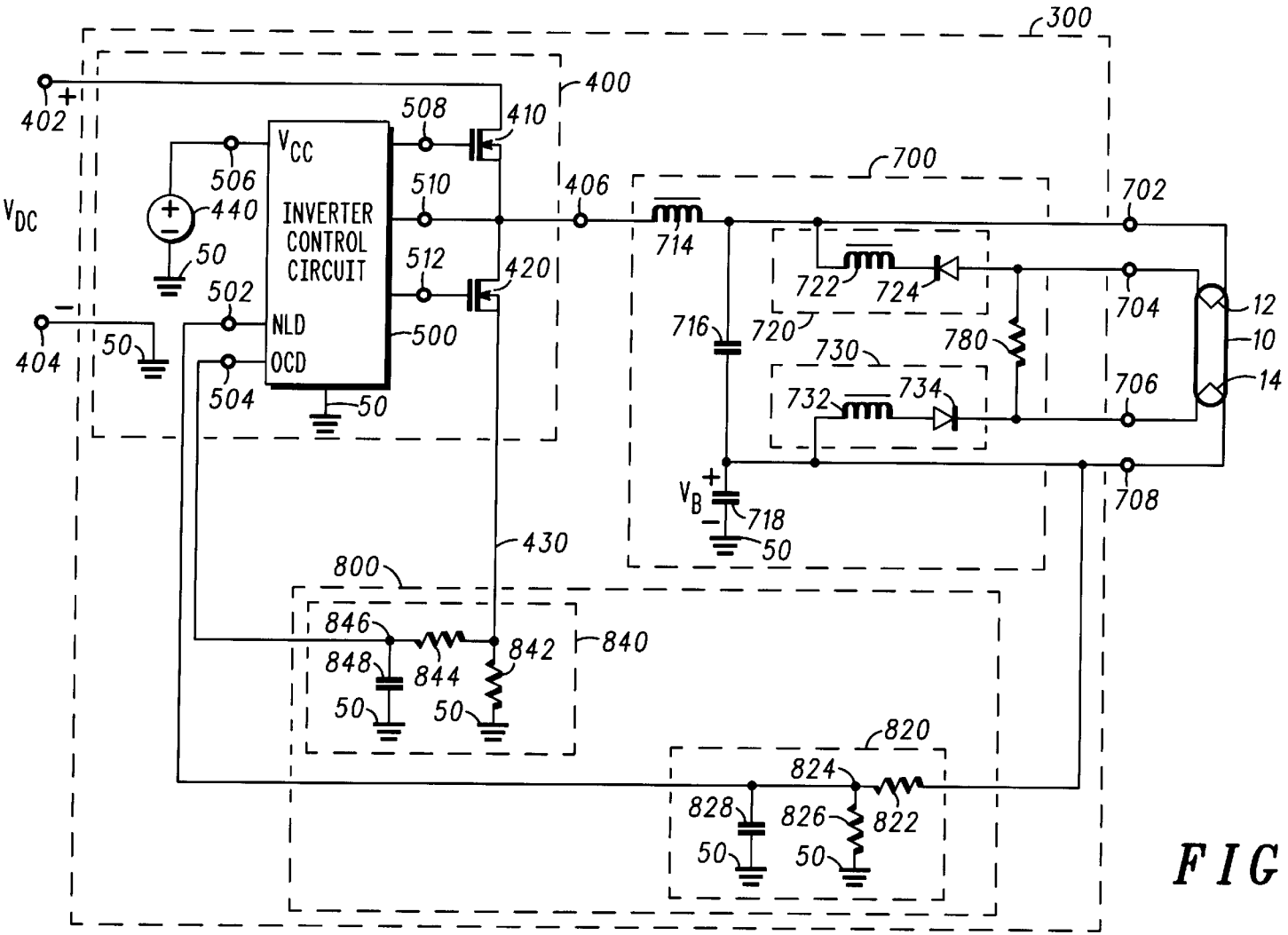
FIG. 3 is a detailed circuit schematic of an electronic ballast with an inverter control circuit, in accordance with a preferred embodiment of the present invention.

Specific preferred circuits for resonant output circuit 700, no-load detection circuit 820, and overcurrent detection circuit 840 are described in FIG. 3. Resonant output circuit 700 comprises a resonant inductor 714, a resonant capacitor 716, a DC blocking capacitor 718, a first filament heating circuit 720, a second filament heating circuit 730, and a filament path resistor 780. Resonant inductor 714 is coupled between inverter output terminal 406 and first output wire 702. Resonant capacitor 716 is coupled between first output wire 702 and fourth output wire 708. DC blocking capacitor 718 is coupled between fourth output wire 708 and circuit ground node 50. Resonant inductor 714 and resonant capacitor 716 are configured as a series resonant circuit that operates in a manner that is well-known to those skilled in the art of resonant converters and electronic ballasts. During normal operation, DC blocking capacitor 718 has a voltage, $V_B$, that is equal to approximately one-half the average (DC) value of $V_{DC}$. Since the voltage between inverter output terminal 406 and circuit ground node 50 essentially varies between zero (when transistor 420 is on) and $V_{DC}$ (when transistor 410 is on), and since the voltage across DC blocking capacitor 718 is $V_{DC}/2$, the resonant circuit is excited by a substantially symmetrical squarewave voltage that varies between $+V_{DC}/2$ and $-V_{DC}/2$.

Filament path resistor 780 is coupled between second output wire 704 and third output wire 706. First filament heating circuit 720 is coupled between first output wire 702 and second output wire 704. Second filament heating circuit 730 is coupled between third output wire 706 and fourth output wire 708. First filament heating circuit 720 preferably comprises a series combination of a first inductor 722 and a first blocking element 724. Second filament heating circuit 730 preferably comprises a series combination of a second inductor 732 and a second blocking element 734. First inductor 722 and second inductor 732 are magnetically coupled to resonant inductor 714 and operate in essentially the same manner as secondary windings in a step-down transformer. First and second blocking elements 724,734 may be implemented either as diodes (as in FIG. 3) or as capacitors (not shown). Blocking elements 724,734 serve to substantially prevent DC current from flowing through filament path resistor 780 in the event that one or both of the filaments 12,14 become open due to filament failure or disconnection of lamp 10 from output wires 702, . . . ,708. As will be explained in greater detail below, the DC current that flows through resistor 780 when lamp 10 is properly connected to ballast 300 with both of its filaments 12,14 intact is relevant to the operation of no-load detection circuit 820 and inverter control circuit 500. Use of capacitors for blocking elements 724,734 provides the added benefit of protecting inductors 722,732 from high current and possible destruction if output wires 702,704 and/or output wires 706,708 are inadvertently shorted due to miswiring or improper connection of lamp 10.

As illustrated in FIG. 3, no-load detection circuit 820 and overcurrent detection circuit 840 may be implemented using relatively few electrical components. Preferably, no-load detection circuit 820 comprises a first resistor 822 and a second resistor 826. First resistor 822 is coupled between fourth output wire 708 and a fourth node 824. Second resistor 826 is coupled between fourth node 824 and circuit ground node 50. Fourth node 824 is coupled to NLD input 502 of inverter control circuit 500. No-load detection circuit 820 optionally includes a capacitor 828 coupled between fourth node 824 and circuit ground node 50. Capacitor 828 tends to reduce or prevent sudden fluctuations in the voltage at fourth node 824 and thus provides a useful degree of noise filtering that stabilizes the signal applied to NLD input 502.

During operation of ballast 300, no-load detection circuit 820 monitors the voltage, $V_B$, across DC blocking capacitor 718. As discussed previously, the normal operating voltage across DC blocking capacitor 718 is approximately one-half the average (DC) value of $V_{DC}$, and is typically on the order of 100 volts or greater. Resistors 822,826 serve as a voltage divider and provide a scaled-down version of $V_B$ (e.g., on the order of a few volts) to the NLD input 502 of inverter control circuit 500. As long as $V_B$ remains above a certain value, a "logic 1" (e.g., greater than 0.6 volts) is provided at NLD input 502.

When inverter 400 initially begins to operate at t=0, ballast 300 is in the filament preheating mode and remains in this mode until at least $t=t_{PREHEAT}$. During the filament preheating mode, lamp 10 is not yet conductive. If both filaments 12,14 are intact and properly connected to output wires 702, . . . 708, a small DC current flows through filament path resistor 780 and into DC blocking capacitor 718. Within a relatively short period of time, the voltage across DC blocking capacitor 718 reaches its operating value of $V_{DC}/2$ and no-load detection circuit 820 thus provides a logic "1" at NLD input 502.

If lamp 10 is not present, or if at least of its filaments 12,14 is not intact and/or is not properly connected, when power is applied to ballast 300, no DC current will flow through resistor 780. Since DC blocking capacitor 718 is deprived of charging current, $V_B$ remains at its initial (uncharged) value of zero. Consequently, no-load detection circuit provides a logic "0" at NLD input 502, thus notifying inverter control circuit 500 that a no-lamp or open filament fault condition exists. As discussed previously, such a fault condition causes inverter control circuit 500 to hold ballast 300 in the preheat mode until at least such time as the fault condition is corrected.

When lamp 10 is operating, the voltage across DC blocking capacitor 718 is maintained by a small DC current that flows primarily through lamp 10. A DC current also flows through filament path resistor 780, but is usually small in comparison with that which flows through lamp 10. If lamp 10 is removed during operation, DC blocking capacitor 718 is deprived of sustaining current and rapidly discharges through resistors 822,826. The resulting decay in $V_B$ results in a logic "0" at NLD input 502.

When lamp 10 is operating, if one or both of its filaments 12,14 suddenly become open, DC current will no longer flow through filament path resistor 780. However, as long as lamp 10 remains lit and continues to conduct at least some arc current, $V_B$ will continue to be maintained by the small DC current that flows through lamp 10. Thus, no-load detection circuit 820 will continue to provide a logic "1" to NLD input 502 for at least as long as lamp 10 remains lit. Filament failure in this case is not treated as a lamp fault condition since it poses no danger to inverter 400 and output circuit 700. It should be appreciated, however, that if ballast power is removed and then reapplied at some later time, the open filament condition will be treated as a fault condition since the unignited lamp will be incapable of providing charging current to DC blocking capacitor 718. Additionally, it should be noted that an open filament condition that occurs while lamp 10 is operating is usually a precursor to, or consequence of, diode-lamp operation, in which case overcurrent detection circuit 840 will notify inverter control circuit 500 that a lamp fault condition exists.

Referring again to FIG. 3, overcurrent detection circuit 840 preferably comprises a current-sensing resistor 842, a third resistor 844, and a first capacitor 848. Current-sensing resistor is coupled between first node 430 and circuit ground node 50. Third resistor 844 is coupled between first node 430 and a fifth node 846. First capacitor 848 is coupled between fifth node 846 and circuit ground node 50. Fifth node 846 is coupled to OCD input 504 of inverter control circuit 500. Third resistor 844 and first capacitor 848 together provide a useful degree of noise suppression that prevents or reduces the likelihood of a logic "1" appearing at OCD input 504 in response to spurious effects that normally occur during ignition of lamp 10.

During operation of ballast 300, current-sensing resistor 842 develops a voltage that is proportional to the current that flows through transistor 420 when transistor 420 is on. When lamp 10 is operating normally, the voltage across resistor 842 remains low enough so that a logic "0" is provided at OCD input 504. On the other hand, if lamp 10 is removed or begins to operate in an abnormal manner, the current through transistor 420 will increase significantly. Correspondingly, the voltage across resistor 842 will increase and a logic "1" will be provided to OCD input 504, thereby notifying inverter control circuit 500 that a lamp fault condition exists. While ballast 300 is in the filament preheating and low-power protection modes, and during at least a first portion of the frequency shifting mode, the current through transistor 420 is low enough so that, regardless of the condition of lamp 10, a logic "0" is provided at OCD input 504.

Figure 4:
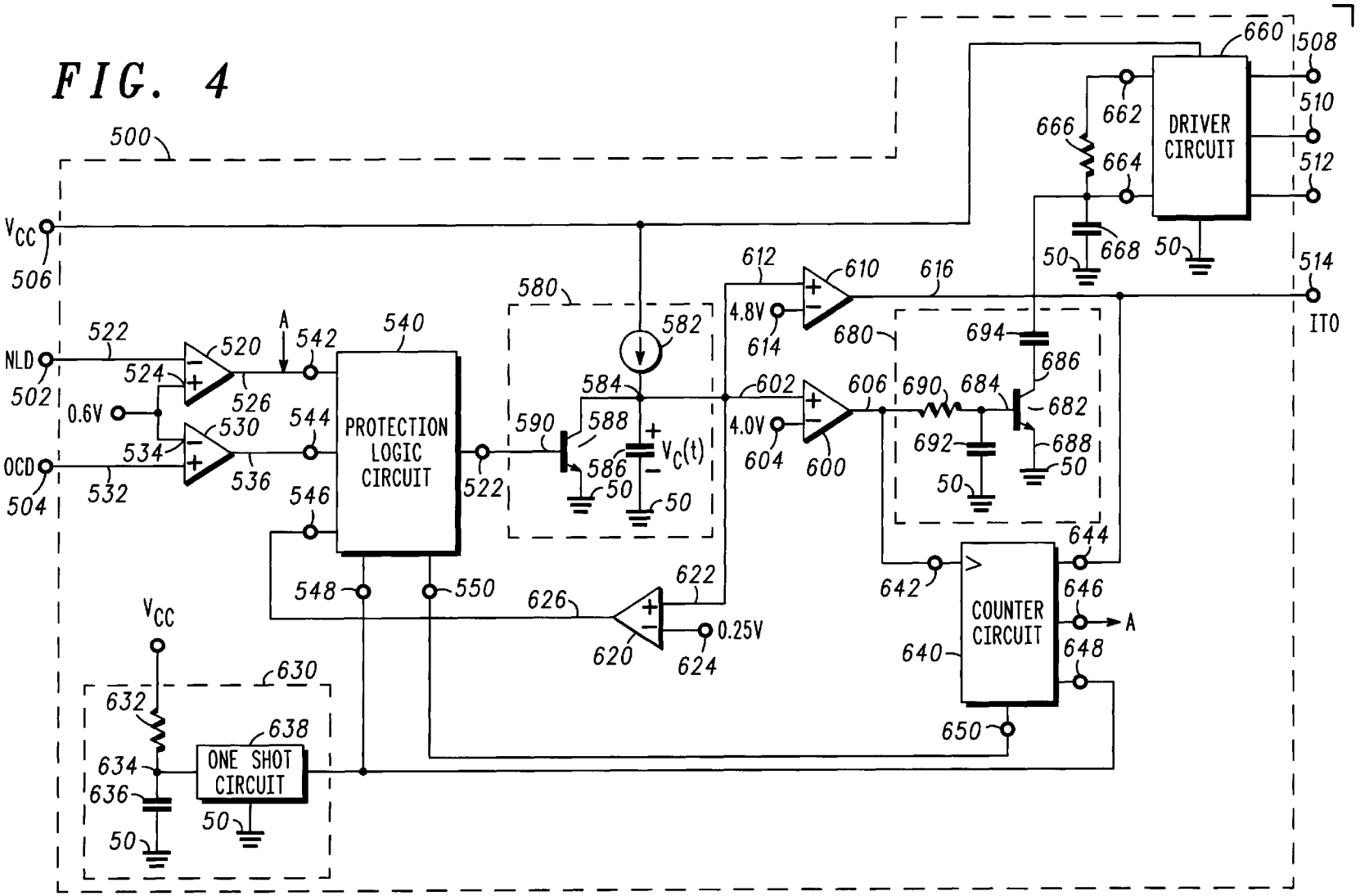
FIG. 4 describes a preferred structure for an inverter control circuit, in accordance with a preferred embodiment of the present invention.

Turning now to FIG. 4, in a preferred embodiment of ballast 300, inverter control circuit 500 comprises a first comparator 520 and a second comparator 530. First comparator 520 has an inverting input 522 coupled to NLD input 502, a non-inverting input 524 coupled to a fault reference voltage (e.g., 0.6 volts), and an output 526. During operation, first comparator 520 provides a logic "0" at its output 526 when the voltage at NLD input 502 exceeds 0.6 volts, and a logic "1" at output 526 when the voltage at NLD input 502 is less than 0.6 volts. Second comparator 530 has a non-inverting input 532 coupled to OCD input 504, an inverting input 534 coupled to the fault reference voltage, and an output 536. During operation, second comparator 530 provides a logic "1" at output 536 when the voltage at OCD input 504 exceeds 0.6 volts, and a logic "0" at output 536 when the voltage at OCD input 504 is less than 0.6 volts. Thus, during normal operation of ballast 300 when lamp 10 is conducting current in a substantially normal fashion, a logic "0" is present at both of the outputs 526,536 of first and second comparators 520,530. Conversely, if a lamp fault condition occurs, a logic "1" will appear at either one or both of the outputs 526,536, and thereby notify the rest of inverter control circuit 500 that protective action is needed.

Figure 5:
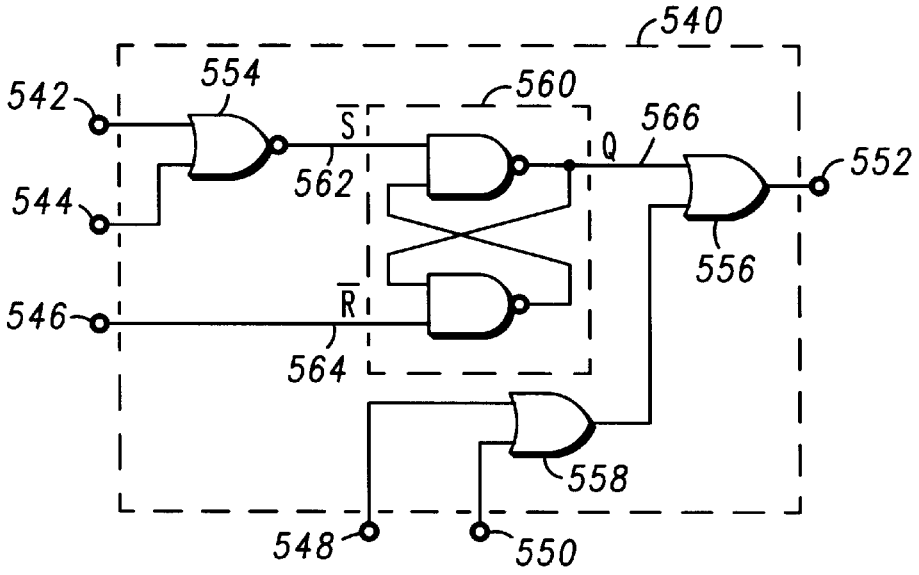
FIG. 5 describes a preferred structure for a protection logic circuit for use in the inverter control circuit of FIG. 4, in accordance with a preferred embodiment of the present invention.

Inverter control circuit 500 further includes a protection logic circuit 540 having a plurality of logic inputs 542, 544, 546, 548, 550 and a logic output 552. The plurality of logic inputs 542, . . . ,550 includes a first logic input 542 coupled to the output 526 of first comparator 520, a second logic input 544 coupled to the output 536 of second comparator 530, a timer reset input 546, a power-up reset input 548, and a repeat disable input 550. During operation, protection logic circuit 540 provides a logic "0" at logic output 552 in response to a logic "0" being present at all of the logic inputs 542, . . . ,550, and a logic "1" at the logic output 552 in response to a logic "1" being present at at least one of the following inputs: first logic input 542, second logic input 544, power-up reset input 548, and repeat disable input 550. As illustrated in FIG. 5, protection logic circuit 540 may be realized as a sequential logic circuit that includes standard logic gates 554, 556, 558 and an asynchronous, negative-logic RS flip-flop 560. A more detailed discussion of the operation of protection logic circuit 540 is given below.

Referring again to FIG. 4, inverter control circuit 500 includes a preheat timing circuit 580 comprising a DC current source 582, a timing capacitor 586, and a discharge switch 588. DC current source 582 is coupled between DC supply input 506 and a second node 584. Timing capacitor 586 is coupled between second node 584 and circuit ground node 50, and has a timing capacitor voltage, $V_C(t)$. Discharge switch 588 is coupled in parallel with timing capacitor 586 and has a control lead 590 coupled to the logic output 552 of protection logic circuit 540. The voltage, $V_C(t)$, across timing capacitor 586 largely controls the durations of the different modes of operation provided by inverter control circuit 500.

Inverter control circuit further includes a preheat timer comparator 600, an ignition timer comparator 610, and a preheat reset comparator 620. Preheat timer comparator 600 has a non-inverting input 602 coupled to second node 584, an inverting input 604 coupled to a preheat timing reference voltage (e.g., 4.0 volts), and an output 606. Preheat timer comparator 600 provides a logic "0" at output 606 when the timing capacitor voltage, $V_C(t)$, is less than 4.0 volts, and a logic "1" when $V_C(t)$ is greater than 4.0 volts. Ignition timer comparator 610 has a non-inverting input 612 coupled to second node 584, an inverting input 614 coupled to an ignition timing reference voltage (e.g., 4.8 volts), and an output 616. Ignition timer comparator 610 provides a logic "0" at its output 616 when $V_C(t)$ is less than 4.8 volts, and a logic "1" when $V_C(t)$ exceeds 4.8 volts. Preheat reset comparator 620 has a non-inverting input 622 coupled to second node 584, an inverting input 624 coupled to a timer reset reference voltage (e.g., 0.25 volts), and an output 626 coupled to the timer reset input 546 of protection logic circuit 540. Preheat reset comparator 620 provides a logic "1" at its output 626 when $V_C(t)$ is greater than 0.25 volts, and a logic "0" when $V_C(t)$ is less than 0.25 volts.

Inverter control circuit 500 further comprises a power-up reset circuit 630. Power-up reset circuit 630 includes a triggering resistor 632, a triggering capacitor 636, and a one-shot circuit 638. Triggering resistor 632 is coupled between DC supply input 506 and a third node 634. Triggering capacitor 636 is coupled between the third node 634 and circuit ground node 50. One-shot circuit 638 is coupled between third node 634 and the power-up reset input 548 of protection logic circuit 540. Following initial application of power to the ballast, or cycling of the power to the ballast, one-shot circuit 636 triggers and provides a momentary voltage pulse (i.e., a logic "1") at power-up reset input 548 in response to the voltage at third node 634 reaching a predetermined trigger threshold. One-shot circuit may be implemented using any of a number of well-known devices or circuits.

Inverter control circuit 500 further comprises a counter circuit 640 that includes a clock input 642, a first reset input 644, a second reset input 646, a third reset input 648, and a counter output 650. Clock input 642 is coupled to output 606 of preheat timer comparator 600. First reset input 644 is coupled to output 616 of ignition timer comparator 616. Second reset input 646 is coupled (via "A") to output 526 of first comparator 520. Third reset input 648 is coupled to power-up reset circuit 630. Counter output 650 is coupled to the repeat disable input 550 of protection logic circuit 540. Counter circuit 640 has an internal count that keeps track of the number of times, N, that the filament preheating mode is performed. More specifically, counter circuit 640 is operable to:

(a) initialize the count (i.e., set N=0) in response to a logic "1" being applied to either of the three reset inputs 644, 646, 648;

(b) increment the count by one (i.e., N=N+1) in response to the output 606 of preheat timing comparator 600 changing from a logic "0" to a logic "1";

(c) provide a logic "0" at counter output 650 as long as N is less than a predetermined count limit, $N_{LIMIT}$; and (d) provide a logic "1" at counter output 650 when N reaches $N_{LIMIT}$.

Figure 6:
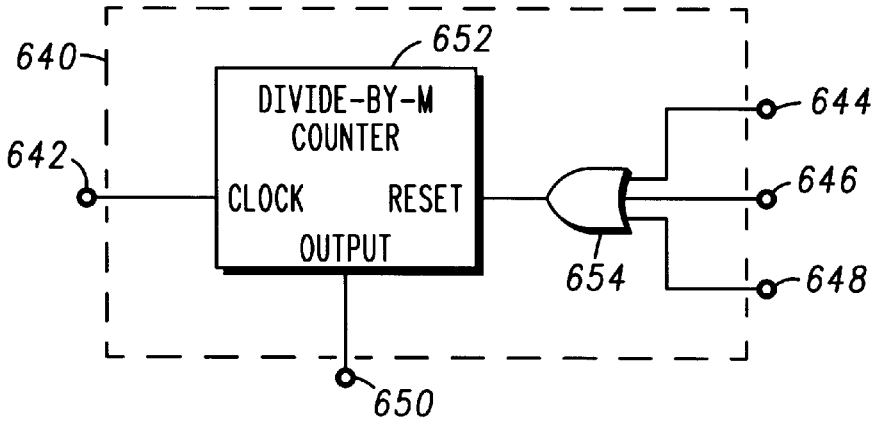
FIG. 6 describes a preferred structure for a counter circuit for use in the inverter control circuit of FIG. 4, in accordance with a preferred embodiment of the present invention.

Referring momentarily to FIG. 6, counter circuit 640 is preferably implemented using a divide-by-M counter 652 and an OR gate 654. For ease of realization, M is preferably chosen to be a multiple of two, such 4, 8, 16, 32, etc., Counter 652 is reset (i.e., N=0) if a logic "1" is applied to either of the three inputs 644, 646, 648 to OR gate 654. A positive-edge transition at clock input 642 causes N to increase by one. The counter output 650 remains a logic "0" as long as N is less than M, and becomes a logic "1" when N=M.

Turning back to FIG. 4, inverter control circuit 500 further comprises a driver circuit 660, a frequency-determining resistance 666, and a frequency-determining capacitance 668. Driver circuit 660 is coupled to the inverter switches via outputs 508, 510, 512, and includes a first input 662 and a second input 664. Driver circuit 660 provides complementary switching of the inverter switches and may be realized using any of a number of circuits well-known to those skilled in the art, such as circuitry substantially similar to that which is employed in the IR2151 high-side driver integrated circuit (IC) manufactured by International Rectifier. Resistance 666 is coupled between first input 662 and second input 664 of driver circuit 660. Capacitance 668 is coupled between second input 664 and circuit ground node 50. Resistance 666 and capacitance 668 together determine the preheat frequency, $f_{PREHEAT}$, at which driver circuit 660 commutates the inverter switches when no external bias is applied to second input 664.

Inverter control circuit 500 further comprises a frequency sweep circuit 680 coupled between the output 606 of preheat timer comparator 600 and the second input 664 of driver circuit 660. Frequency sweep circuit 680 and driver circuit 660 operate together to set $f_{DRIVE}$ in dependence on the output 606 of preheat timer comparator 600. More specifically, frequency sweep circuit 680 and inverter driver circuit 660 are operable:

(a) in response to the output 606 of preheat timer comparator 600 changing from a logic "0" to a logic "1", to shift $f_{DRIVE}$ from $f_{PREHEAT}$ to $f_{OPERATING}$, and then maintain $f_{DRIVE}=f_{OPERATING}$ for at least as long as a logic "1" remains at output 606; and (b) in response to the output 606 of preheat timer comparator 600 being a logic "0", to set $f_{DRIVE}=f_{PREHEAT}$ and then maintain $f_{DRIVE}=f_{PREHEAT}$ for at least as long as a logic "0" remains at output 606.

Figure 7:
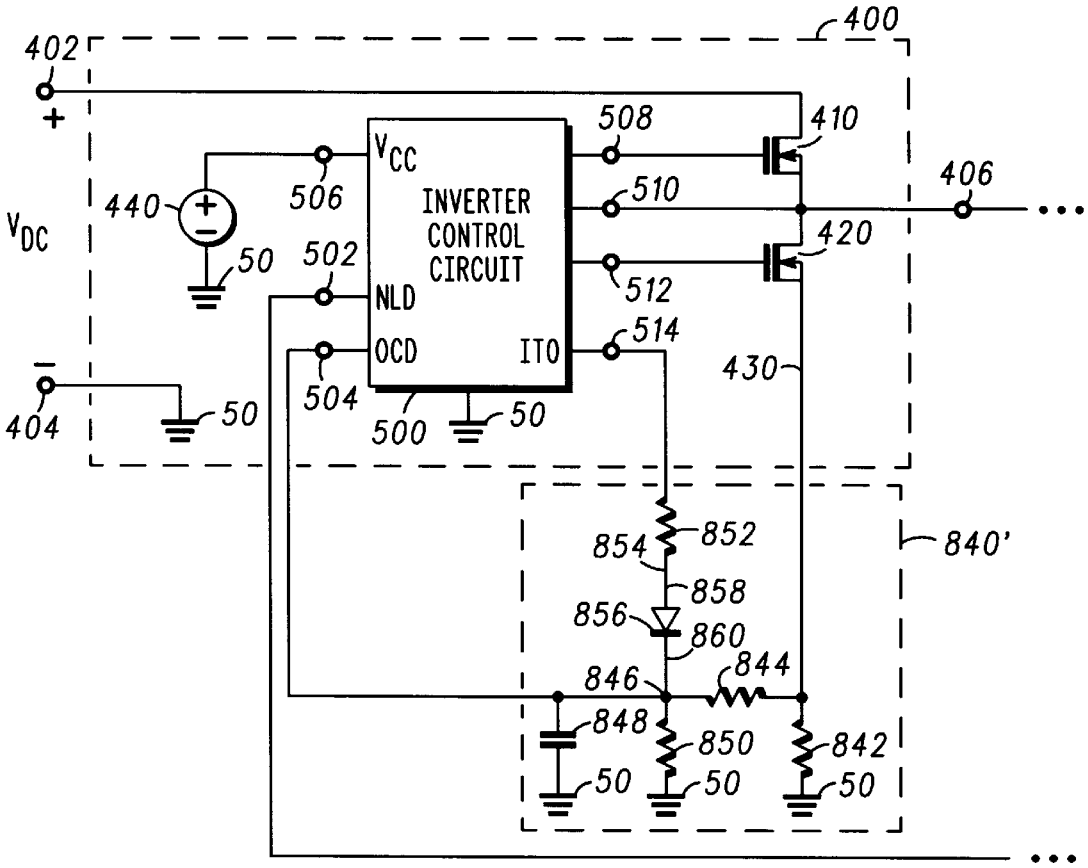
FIG. 7 describes an overcurrent detection circuit with an adjustable overcurrent detection threshold, in accordance with a preferred embodiment of the present invention.

Preferably, frequency sweep circuit 680 accomplishes (a) by effectively augmenting (i.e., adding to) the frequency determining capacitance 668. As illustrated in FIG. 7, frequency sweep circuit 680 preferably comprises a sweep switch 682, a sweep timing resistor 690, a sweep timing capacitor 692, and an augmenting capacitor 694. Sweep switch 682, which is depicted as a bipolar junction transistor, has a base lead 684, a collector lead 686, and an emitter lead 688. Emitter lead 688 is coupled to circuit ground node 50. Sweep timing resistor 690 is coupled between the output 606 of preheat timer comparator 606 and the base lead 684 of sweep switch 682. Sweep timing capacitor 692 is coupled between base lead 684 and circuit ground node 50. Augmenting capacitor 694 is coupled between the collector lead 686 of sweep switch 682 and the second input 664 of driver circuit 660.

As long as output 606 is low (i.e., a logic "0"), insufficient voltage exists at base lead 684 to turn transistor 682 on. Since augmenting capacitor 694 exerts essentially no influence on second input 664 of driver circuit 660 when transistor 682 is off, $f_{DRIVE}$ is determined by resistor 666 and capacitor 668. That is, with sweep switch 682 off, $f_{DRIVE}$ is set at $f_{PREHEAT}$. When the output 606 of preheat timer comparator 600 changes from a logic "0" to a logic "1" upon conclusion of the preheating period at $t=t_{PREHEAT}$, timing capacitor 692 begins to charge up. Once the voltage across capacitor 692 approaches 0.6 volts, transistor 682 begins to turn on. This effectively couples the lower end of augmenting capacitor 694 to circuit ground node 50, and thus effectively places capacitor 694 in parallel with capacitor 668. The end result is an increase in the effective frequency determining capacitance of driver circuit 660. Consequently, $f_{DRIVE}$ decreases from $f_{PREHEAT}$ to $f_{OOERATING}$, and then remains at $f_{OPERATING}$ for at least as long as a logic "1" remains at output 606 of preheat timing comparator 600.

As described in FIG. 4, inverter control circuit 500 is largely composed of low-voltage, low-power circuitry and is therefore well-suited for implementation as a single custom integrated circuit. This makes inverter control circuit 500 highly advantageous for use in electronic ballasts, for which the resulting low parts count significantly enhances ballast reliability and ease of manufacture.

The detailed operation of inverter control circuit 500 under various operating and lamp fault conditions is now explained with reference to FIGS. 3, 4, 5, and 6 as follows.

First, consider what occurs when lamp 10 is functional with both filaments intact and properly connected to output wires 702, . . . ,708. Following application of power to ballast 300, inverter control circuit 500 begins to operate once $V_{CC}$ reaches a predetermined level (e.g., 12 volts). DC current source 582 is likewise activated once $V_{CC}$ reaches a certain level, and begins to supply current to timing capacitor 586. However, power-up reset circuit 630 is also activated and provides a momentary logic "1" to the power-up reset input 548 of protection logic circuit 540 and the third reset input 648 of counter circuit 640. The momentary logic "1" at third reset input 648 initializes counter circuit 640 (i.e., N=0), and also momentarily causes a logic "1" to appear at logic output 552 of protection logic circuit 540. The logic "1" at output 552 causes transistor 588 to turn on and to "sink" the current provided by DC current source 582, as well as to remove any previously stored charge in timing capacitor 586. After a short period of time (e.g., 10 milliseconds or less), the output of one-shot circuit 638 reverts back to a logic "0". This causes logic output 552 of protection logic circuit 540 to revert back to a logic "0", which then causes transistor 588 to turn off. With transistor 588 off, timing capacitor 586 begins to charge up in a substantially linear manner. Thus, power-up reset circuit initializes counter 640 and preheat timing circuit 580 following application of power to ballast 300.

With frequency sweep switch 682 initially off, driver circuit 660 commutates inverter switches 410,420 at $f_{DRIVE}$ $f_{PREHEAT}$. Since lamp 10 has both filaments intact and properly connected to ballast 300, DC blocking capacitor 718 rapidly charges up to VDC/$^2$, and a logic "1" is correspondingly provided at NLD input 502. Consequently, comparators 520,530 each provide a logic "0" at their outputs 526,536. Since $V_C(t)$ is still less than 0.25 volts, a logic "0" is also provided at the output 626 of preheat reset comparator 620. A logic "0" is also provided at the output 650 of counter circuit 640. Thus, a logic "0" is provided at logic output 552 of protection logic circuit 540, and transistor 588 remains off and allows timing capacitor 588 to continue to charge up.

When $V_C(t)$ reaches 0.25 volts, the output 626 of preheat timing comparator changes from a logic "0" to a logic "1", which is applied to the R input 564 of flip-flop 560. Since flip-flop 560 is a negative-logic device, application of a logic "1" at R input 564 merely prevents resetting of flip-flop 560. On the other hand, a logic "0" at R input 564 causes flip-flop 560 to reset (i.e., Q=0).

Driver circuit 660 continues to commutate the inverter switches at $f_{DRIVE}=f_{PREHEAT}$ until at least such time as $V_C(t)$ reaches 4.0 volts. When $V_C(t)$ reaches 4.0 volts at $t=t_{PREHEAT}$, output 606 of preheat timer comparator 600 changes from a logic "0" to a logic "1" and causes two events to occur. First, counter 640 is incremented (N=1). Secondly, capacitor 692 of frequency sweep circuit 680 begins to charge up through resistor 690. Once the voltage across capacitor 692 approaches about 0.6 volts, sweep switch 682 begins to turn on and thereby effectively places capacitor 694 in parallel with frequency-determining capacitance 668. This causes $f_{DRIVE}$ to begin to decrease from $f_{PREHEAT}$ to $f_{OPERATING}$. Once $f_{DRIVE}$ has decreased to a value reasonably close to $f_{OPERATING}$, sufficient voltage develops across resonant capacitor 716 to ignite lamp 10.

With lamp 10 ignited and operating normally, $V_C(t)$ continues to charge up and eventually reaches 4.8 volts, at which point the output 616 of ignition timer comparator 610 changes from a logic "0" to a logic "1". With a logic "1" at the output 616 of ignition timer comparator 610, a logic "1" is provided at the first reset input 644 of counter 640, and resets counter 640 (i.e., N=0). As long as lamp 10 continues to operate normally, no-load detection circuit 820 and overcurrent detection circuit 840 each continue to provide a logic "0" at NLD input 502 and OCD input 504. $V_C(t)$ continues to increase and eventually reaches a peak value that is approximately equal to $V_{CC}$(e.g., 15 volts).

If, at some future time, lamp 10 is suddenly removed or begins to operate abnormally, a logic "1" will appear at OCD input 504 and/or a logic "0" will appear at NLD input 502. In any event, a lamp fault condition will result in a logic "1" being applied to at least one of the first and second logic inputs 542,544 of protection logic circuit 540. Consequently, internal to protection logic circuit 540, NOR gate 554 will provide a logic "0" to the S input 562 of flip-flop 560. This causes the Q output 566 to change from a logic "0" to a logic "1", which then causes a logic "1" to appear (via OR gate 556) at logic output 552. With a logic "1" at logic output 552, transistor 588 of timing circuit 590 turns on and discharges timing capacitor 586. When $V_C(t)$ falls below 4.0 volts, output 606 of preheat timer comparator 600 reverts to a logic "0" and turns off transistor 682 of sweep circuit 680. With transistor 682 now off, capacitor 694 is effectively "switched out" and $f_{DRIVE}$ changes from $f_{OPERATING}$ to $f_{PREHEAT}$. With ballast 300 now operating at $f_{DRIVE}=f_{PREHEAT}$, inverter 400 and output circuit 700 are protected from any damage due to the lamp fault condition.

If the lamp fault condition that precipitated the preceding events was caused by removal of lamp 10, then a logic "0"

will remain at NLD input 502 even after $f_{DRIVE}$ has been shifted to $f_{PREHEAT}$. Ballast 300 then remains in the preheat mode with $f_{DRIVE}=f_{PREHEAT}$ until at least such time as lamp 10 is replaced with a functional lamp. If the lamp fault condition was due to lamp 10 becoming degassed, for example, once $f_{DRIVE}$ is shifted to $f_{PREHEAT}$, the logic "1" that was previously present at OCD input 504 will revert back to a logic "0". This is so because operating inverter 300 at $f_{PREHEAT}$ inherently reduces the current through inverter switch 430 and thus causes overcurrent detection circuit 840 to provide a logic "0" at OCD input 504. Subsequently, inverter control circuit 500 will repeat the preheat and shifting modes a number of times in order to verify the legitimacy of the lamp fault condition before entering the protection mode.

As described previously, in response to lamp 10 becoming degassed, protection logic circuit 540 turns transistor 588 on, which then discharges timing capacitor 588. $f_{DRIVE}$ reverts to $f_{PREHEAT}$ when $V_C(t)$ falls below 4.0 volts. Since the fault condition latches flip-flop 560 at Q=1, a logic "1" remains at logic output 552 until such time as a logic "0" is applied to the R input 564. When $V_C(t)$ falls below 0.25 volts, output 626 of preheat reset comparator 620 changes from a logic "1" to a logic "0" and thereby resets flip-flop 560 (i.e., Q=0). This causes a logic "0" at logic output 552 and turns transistor 588 off. With transistor 588 off, timing capacitor 586 begins to charge up again. Once $V_C(t)$ increases to 4.0 volts, the count is incremented (i.e., N=N+1) and $f_{DRIVE}$ is shifted from $f_{PREHEAT}$ to $f_{OPERATING}$ in the manner previously described.

Since, in this example, lamp 10 is degassed and is therefore incapable of initiating or sustaining an arc, lamp will not ignite as $f_{DRIVE}$ approaches $f_{OPERATING}$. Consequently, overcurrent detection circuit 840 will again provide a logic "1" at OCD input 504, which will cause inverter control circuit 500 to change $f_{DRIVE}$ back to $f_{PREHEAT}$ in the manner previously described. Importantly, $V_C(t)$ is never allowed to reach 4.8 volts in this case since protection logic circuit 540 activates transistor 588 and discharges timing capacitor 586 when lamp 10 fails to ignite by $t=t_{IGNITE}$. Because $V_C(t)$ does not reach 4.8 volts, counter circuit 640 is not reset and thus keeps track of the number of consecutive unsuccessful attempts to ignite lamp 10.

The preheat and shifting modes will then be repeated a number of times until the count, N, reaches M, at which point ballast 300 enters the low-power protection mode. More specifically, after the preheat mode has been performed M times, the count of counter circuit 640 reaches M and the output 650 of counter circuit 640 changes from a logic "0" to a logic "1", which is then applied to repeat disable input 550. The presence of a logic "1" at repeat disable input 550 causes a logic "1" to appear at output 552, turns transistor 588 on, and changes $f_{DRIVE}$ to $f_{PREHEAT}$. Subsequently, transistor 588 remains on, and $f_{DRIVE}$ is maintained at $f_{OPERATING}$, until at least such time as counter 640 is reset.

Note that the preheat mode may be repeated up to M times in succession, and the shifting mode up to (M−1) times in succession, when an operating lamp begins to exhibit degassed or diode-mode behavior. For example, if lamp 10 begins to behave as a diode-mode lamp, it will be observed to flash on and off (M−1) times before the ballast finally gives up and enters the low-power protection mode.

The aforementioned events are similarly performed in the case of a functional lamp that, due to being in a low-temperature environment, fails to ignite and operate normally on the first attempt. Inverter control circuit 500 will repeat the preheat and shifting modes up to a number of times, and thus provide multiple ignition attempts if needed.

Once ballast 300 enters the low-power protection mode, $f_{DRIVE}$ remains at $f_{PREHEAT}$ until at least such time as lamp 10 is removed or the power to ballast 300 is cycled. Since $V_C(t)$ is approximately zero and is therefore less than 0.25 volts, a logic "0" is present at output 626 of preheat reset comparator 620. Further, a logic "0" is likewise present at output 566 of flip-flop 560. Hence, the logic "1" that is present at repeat disable input 550 (due to the output 650 of counter circuit 640 being a logic "1") is all that maintains a logic "1" at output 552. If lamp 10 is removed, a logic "0" appears at NLD input 502 and causes output 526 of first comparator 520 to change to a logic "1". Since output 526 of first comparator 520 is coupled to second reset input 646 of counter circuit 640, a logic "1" at output 526 resets counter 640 and thus causes counter output 650 to change to a logic "0". This causes logic output 552 of protection logic circuit 540 to change back to a logic "0", which turns transistor 588 off and allows ballast 300 to enter the filament preheat mode. Ballast 300 will then remain in the preheat mode until a new lamp is inserted in place of removed lamp 10, at which point the preheat and shifting modes will be performed as previously described.

Referring to FIG. 4, inverter control circuit 500 preferably includes an ignition timing output 514 that is coupled to output 616 of ignition timer comparator 610, and at which a logic "1" is provided within a short period of time after $t=t_{IGNITE}$ if lamp 10 ignites and begins to operate normally by $t=t_{IGNITE}$. Ignition timing output 514 can be used to control the detection threshold of an appropriately modified overcurrent detection circuit. An alternative overcurrent detection circuit that provides an adjustable fault detection threshold is described in FIG. 7.

As described in FIG. 7, overcurrent detection circuit 840' includes current-sensing resistor 842, third resistor 844, first capacitor 848, a fourth resistor 852, and a first diode 856. As previously recited, current-sensing resistor 842 is coupled between first node 430 and circuit ground node 50, third resistor 844 is coupled between first node 430 and fifth node 846, and fifth node 846 is coupled to OCD input 504 of inverter control circuit 500. First capacitor 848 is coupled between fifth node 846 and circuit ground node 50. Fourth resistor 852 is coupled between ignition timing output 514 of inverter control circuit 500 and a sixth node 854. First diode 856 has an anode 858 coupled to sixth node 854 and a cathode 860 coupled to fifth node 846. Overcurrent detection circuit 840' optionally includes a fifth resistor 850 coupled between fifth node 846 and circuit ground node 50. Fifth resistor 850 facilitates fine-tuning of the fault detection threshold.

Referring to FIGS. 4 and 7, prior to $V_C(t)$ reaching 4.8 volts (which occurs following successful ignition and initial normal operation of lamp 10), a logic "0" is present at ignition timing output 514. That is, the voltage at ignition timing output is low enough (e.g., less than 0.6 volts) so that diode 856 is reverse-biased. During this time, therefore, diode 856 and resistor 852 play essentially no part in the operation of overcurrent detection circuit 840', which thus operates in the manner previously described with reference to FIG. 3.

Once $V_C(t)$ reaches 4.8 volts, a logic "1" appears at ignition timing output 514 and causes diode 856 to become forward-biased. With diode 856 conducting, an amount of DC current is injected into node 846 and produces a bias voltage across resistor 850. This bias voltage has the effect of reducing the amount of current that must flow in inverter switch 420 in order to produce a logic "1" at OCD input 504. Stated another way, the presence of a logic "1" at ignition timing output 514 increases the sensitivity of overcurrent detection circuit 840'.

As a simple numerical example, the fault detection threshold may be set such that, prior to ignition of lamp 10, at least 800 milliamperes of current must flow in inverter switch 420 in order for overcurrent detection circuit 820' to provide a logic "1" at OCD input 504. Conversely, after lamp 10 ignites and begins to operate normally, only 500 milliamperes or more of current must flow in inverter switch 420 in order for a logic "1" to be provided at OCD input 504.

Figure 8:
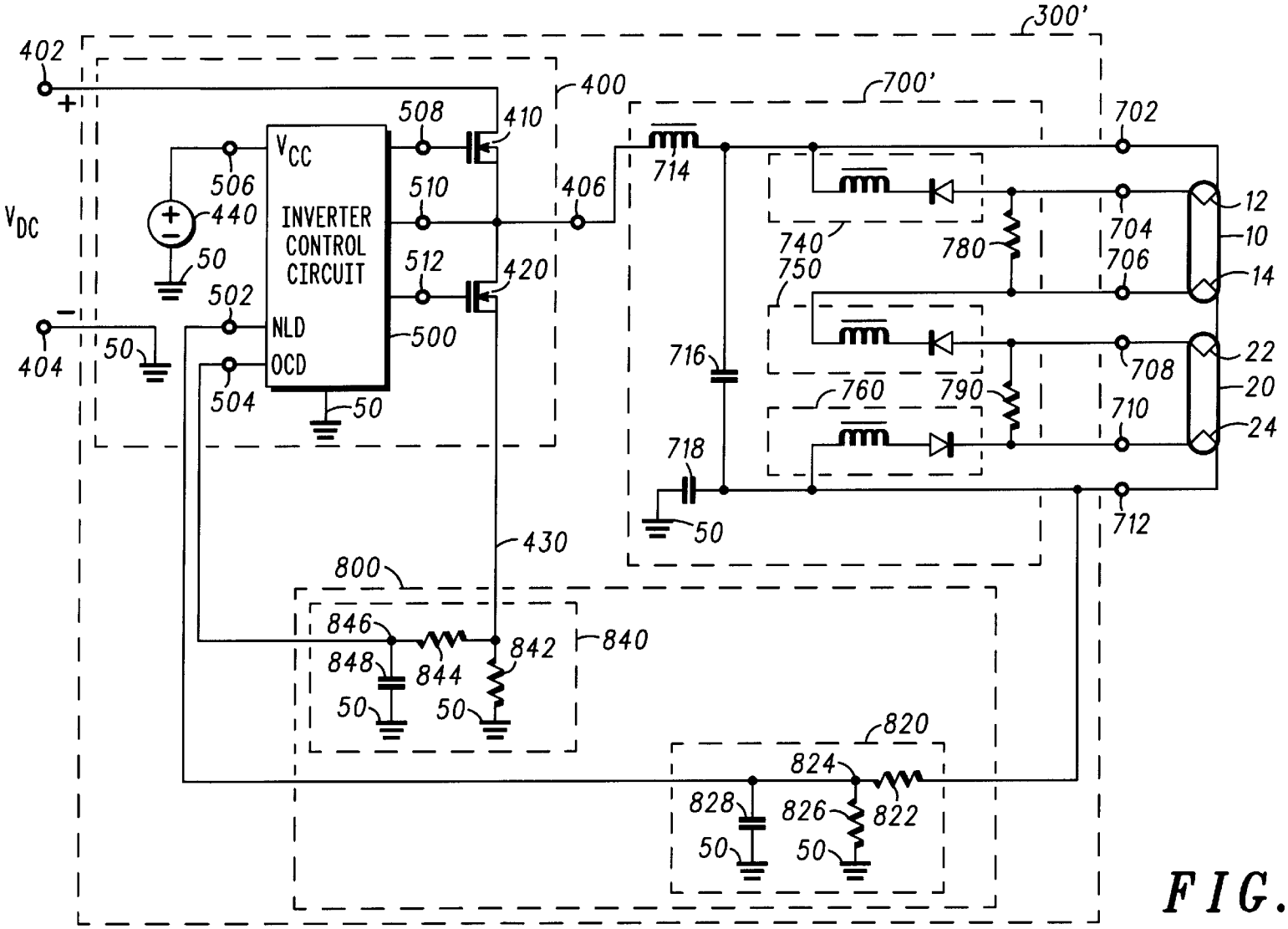
FIG. 8 describes an electronic ballast for powering two gas discharge lamps, in accordance with a preferred embodiment of the present invention.

It should be appreciated that ballast 300 is not limited to powering a single gas discharge lamp, but may be readily modified to power a plurality of gas discharge lamps. For example, FIG. 8 describes a ballast 300' for powering two gas discharge lamps 10,20. Apart from output circuit 700', all other parts of ballast 300, including inverter 400, inverter control circuit 500, no-load detection circuit 820, and overcurrent detection circuit 840 require no structural modification and remain unchanged from the foregoing description.

Output circuit 700' comprises a set of output wires 702, . . . ,712, a resonant inductor 714, a resonant capacitor 716, a DC blocking capacitor 718, a first filament heating circuit 720, a second filament heating circuit 740, a third filament heating circuit 760, and a filament path resistor 780. First output wire 702 is coupleable to second output wire 704 through a first filament 12 of a first lamp 10. Third output wire 706 is coupleable to fourth output wire 708 through a second filament 14 of first lamp 10. Second filament 14 of first lamp 10 is coupleable in parallel with a first filament 22 of second lamp 20. Fifth output wire 710 is coupleable to sixth output wire 712 through a second filament 24 of second lamp 20. Resonant inductor 714 is coupled between inverter output terminal 406 and first output wire 702. Resonant capacitor 716 is coupled between first output wire 702 and sixth output wire 712. DC blocking capacitor 718 is coupled between sixth output wire 712 and circuit ground node 50. First filament heating circuit 720 is coupled between first and second output wires 702,704. Second filament heating circuit 740 is coupled between third and fourth output wires 706,708. Third filament heating circuit 760 is coupled between fifth and sixth output wires 710,712. First filament path resistor 780 is coupled between second and third output wires 704,706. Second filament path resistor 790 is coupled between fourth and fifth output wires 710,712.

During operation of ballast 300', inverter control circuit 500 provides the following operating modes:

(1) a filament preheating mode wherein the drive frequency, $f_{DRIVE}$, is maintained at a preheat frequency, $f_{PREHEAT}$, for a predetermined preheating period, $0<t\leqq t_{PREHEAT}$;

(2) a frequency shifting mode in which $f_{DRIVE}$ is shifted from $f_{PREHEAT}$ to an operating frequency, $f_{OPERATING}$;

(3) a high-power operating mode in which $f_{DRIVE}$ is maintained at $f_{OPERATING}$ in response to successful ignition and normal operation of all lamps within a predetermined ignition period, $t_{PREHEAT}<t\leqq t_{IGNITE}$, followed by continued normal operation of all lamps after ignition,;

(4) a repeating mode wherein the filament preheating and frequency shifting modes are repeated up to a predetermined number of times, $N_{REPEAT}$, in response to each of the following conditions:

(i) failure of at least one of the lamps to ignite and operate normally within the ignition period when all lamp filaments are intact and properly connected to the output wires;

(ii) failure of at least one of the lamps to continue to operate normally after igniting;

(5) a low-power protection mode in which $f_{DRIVE}$ is set to $f_{PREHEAT}$ in response to each of the following conditions:

(i) at least one of the lamps being removed; and (ii) at least one of the lamps failing to ignite and operate normally within the ignition period after the repeating mode has been carried out $N_{REPEAT}$ times.

During operation of ballast 300', no-load detection circuit 820 provides a logic "1" at NLD input 502 in response to each of the following conditions: (i) all lamp filaments being intact and properly connected to the output wires; and (ii) all of the lamps conducting arc current. No-load detection circuit 820 provides a logic "0" at NLD input 502 in response to each of the following conditions: (i) removal of at least one lamp; and (ii) at least one lamp filament being open when each of the lamps is not conducting arc current. Thus, during normal operation with functional lamps, NLD input 502 will have a logic "1". If one or more filaments become open while the lamps are operating, no-load detection circuit 820 will continue to provide a logic "1" at NLD input 502 as long as each of the lamps continue to conduct at least some arc current.

During operation of ballast 300', overcurrent detection circuit 840 provides a logic "0" at OCD input 504 in response to all of the lamps conducting current in a substantially normal manner when the ballast is in the high-power operating mode. Overcurrent detection circuit 840 provides a logic "1" at OCD input 504 in response to each of the following conditions: (i) failure of at least one of the lamps to ignite and operate normally within the ignition period; and (ii) failure of at least one of the lamps to continue to conduct current in a substantially normal manner after igniting.

Although the present invention has been described with reference to certain preferred embodiments, numerous modifications and variations can be made by those skilled in the art without departing from the novel spirit and scope of this invention.

What is claimed is:

1. An electronic ballast for powering at least one gas discharge lamp having a pair of heatable filaments, comprising:

an inverter, comprising:

first and second input terminals for receiving a source of input power, wherein the second input terminal is coupled to a circuit ground node;

an inverter output terminal;

a first inverter switch coupled between the first input terminal and the inverter output terminal;

a second inverter switch coupled between the inverter output terminal and a first node; and an inverter control circuit coupled to the first and second inverter switches, and operable to commutate the inverter switches at a drive frequency, the inverter control circuit having a plurality of fault detection inputs and a DC supply input for receiving operating power;

a resonant output circuit coupled to the inverter output terminal, the resonant output circuit having a natural resonant frequency and a plurality of output wires coupleable to the lamp;

a lamp fault detection circuit coupled between the first node, at least one of the output wires, and the fault detection inputs of the inverter control circuit, the lamp fault detection circuit being operable to provide fault detection signals to the fault detection inputs to indicate whether or not a lamp fault condition is present; and wherein the inverter control circuit is further operable to provide:

(a) a filament preheating mode wherein the drive frequency is maintained at a preheat frequency for a predetermined preheating period;

(b) a frequency shifting mode wherein the drive frequency is shifted from the preheat frequency to an operating frequency;

(c) a high-power operating mode wherein the drive frequency is maintained at the operating frequency in response to successful ignition and normal operation of the lamp within a predetermined ignition period, followed by continued normal operation of the lamp after ignition;

(d) a repeating mode wherein the filament preheating and frequency shifting modes are repeated up to a predetermined number of times in response to each of: (i) failure of the lamp to ignite and operate normally within the predetermined ignition period when both lamp filaments are intact and properly connected to the output wires; and (ii) failure of the lamp to operate normally after igniting; and (e) a low-power protection mode wherein the drive frequency is set at the preheat frequency in response to each of: (i) the lamp being disconnected from the ballast; and (ii) the lamp failing to ignite and operate normally within the predetermined ignition period after the repeating mode has been carried out the predetermined number of times.

2. The electronic ballast of claim 1, wherein the low-power protection mode includes holding the drive frequency at the preheat frequency until at least such time as power to the ballast is removed or the lamp is replaced.

3. The electronic ballast of claim 1, wherein the natural resonant frequency of the resonant output circuit is closer to the operating frequency than to the preheat frequency.

4. The electronic ballast of claim 1, wherein:

the fault detection inputs of the inverter control circuit include a no-load detection (NLD) input and an overcurrent detection (OCD) input;

the lamp fault detection circuit comprises:

a no-load detection circuit coupled between at least one of the output wires and the NLD input, wherein the no-load detection circuit is operable to provide at the NLD input:

(a) a logic "1" in response to each of: (i) both lamp filaments being intact and properly connected to the output wires; and (ii) the lamp conducting arc current; and (b) a logic "0" in response to each of: (i) removal of the lamp; and (ii) at least one lamp filament being open when the lamp is not conducting arc current; and an overcurrent detection circuit coupled between the first node and the OCD input, wherein the overcurrent detection circuit is operable to provide at the OCD input:

(a) a logic "0" in response to the lamp operating normally when the ballast is in the high-power operating mode;

(b) a logic "1" in response to each of: (i) failure of the lamp to ignite and operate normally within the predetermined ignition period; and (ii) failure of the lamp to continue to operate normally after ignition.

5. The electronic ballast of claim 4, wherein the overcurrent detection circuit is further operable to provide a logic "0" at the OCD input during the filament preheating and low-power protection modes, and during at least a portion of the frequency shifting mode.

6. The electronic ballast of claim 4, wherein the inverter control circuit further comprises:

a first comparator having an inverting input coupled to the NLD input, a non-inverting input coupled to a fault reference voltage, and an output, the first comparator being operable to provide at its output:

(i) a logic "0" when the voltage at the NLD input exceeds the reference voltage; and (ii) a logic "1" when the voltage at the NLD input is less than the reference voltage; and a second comparator having a non-inverting input coupled to the OCD input, an inverting input coupled to the fault reference voltage, and an output, the second comparator being operable to provide at its output:

(i) a logic "1" when the voltage at the OCD input exceeds the reference voltage; and (ii) a logic "0" when the voltage at the OCD input is less than the reference voltage.

7. The electronic ballast of claim 6, wherein the inverter control circuit further comprises a protection logic circuit having a plurality of logic inputs and a logic output, wherein the plurality of logic inputs includes a first logic input coupled to the output of the first comparator, a second logic input coupled to the output of the second comparator, a timer reset input, a power-up reset input, and a repeat disable input, wherein:

(a) the protection logic circuit is operable to provide a logic "0" at the logic output in response to a logic "0" being present at all of the logic inputs; and (b) the protection logic circuit is operable to provide a logic "1" at the logic output in response to a logic "1" being present at at least one of:

(i) the first logic input;

(ii) the second logic input;

(iii) the power-up reset input; and (iv) the repeat disable input.

8. The electronic ballast of claim 7, wherein the inverter control circuit further includes a preheat timing circuit, comprising:

a DC current source coupled between the DC supply input and a second node;

a timing capacitor coupled between the second node and the circuit ground node, the timing capacitor having a timing capacitor voltage; and a discharge switch coupled in parallel with the timing capacitor and having a control lead coupled to the logic output of the protection logic circuit.

9. The electronic ballast of claim 8, wherein the inverter control circuit further includes a preheat timer comparator having a non-inverting input coupled to the second node, an inverting input coupled to a preheat timing reference voltage, and an output, wherein the preheat timer comparator is operable to provide at its output:

(i) a logic "0" in response to the timing capacitor voltage being less than the preheat timing reference voltage; and (ii) a logic "1" in response to the timing capacitor voltage being greater than the preheat timing reference voltage.

10. The electronic ballast of claim 9, wherein the inverter control circuit further comprises an ignition timer comparator having a non-inverting input coupled to the second node, an inverting input coupled to an ignition timing reference voltage, and an output, wherein the ignition timer comparator is operable to provide at its output:

(i) a logic "0" in response to the timing capacitor voltage being less than the ignition timing reference voltage; and (ii) a logic "1" in response to the timing capacitor voltage being greater than the ignition timing reference voltage.

11. The electronic ballast of claim 10, wherein the inverter control circuit further comprises a preheat reset comparator having a non-inverting input coupled to the second node, an inverting input coupled to a timer reset reference voltage, and an output coupled to the timer reset input of the protection logic circuit, the preheat reset comparator being operable to provide at its output:

(i) a logic "1" in response to the timing capacitor voltage being greater than the timer reset reference voltage; and (ii) a logic "0" in response to the timing capacitor voltage being less than the timer reset reference voltage.

12. The electronic ballast of claim 11, wherein the inverter control circuit further includes a power-up reset circuit, comprising:

a triggering resistor coupled between the DC supply input and a third node;

a triggering capacitor coupled between the third node and the circuit ground node; and a one-shot circuit coupled between the third node and the power-up reset input of the protection logic circuit, wherein the one-shot circuit is operable to trigger and provide a momentary logic "1" at the power-up reset input in response to the voltage at the third node reaching a predetermined trigger threshold following application of power to the ballast.

13. The electronic ballast of claim 12, wherein the inverter control circuit further comprises a counter circuit comprising:

a clock input coupled to the output of the preheat timer comparator;

a first reset input coupled to the output of the ignition timer comparator;

a second reset input coupled to the output of the first comparator;

a third reset input coupled to the power-up reset circuit; and a counter output coupled to the repeat disable input of the protection logic circuit; and wherein the counter circuit has a count and is operable to:

(a) initialize the count in response to a logic "1" being applied to at least one of the first, second, and third reset inputs;

(b) increment the count by one in response to the output of the preheat timing comparator changing from a logic "0" to a logic "1";

(c) provide a logic "0" at the counter output in response to the count being less than a predetermined count limit; and (d) provide a logic "1" at the counter output in response to the count reaching the predetermined count limit.

14. The electronic ballast of claim 13, wherein the counter circuit comprises a divide-by-M counter.

15. The electronic ballast of claim 13, wherein the inverter control circuit further comprises:

a driver circuit operable to commutate the first and second inverter switches at the drive frequency and in a substantially complementary fashion, the driver circuit including a first input and a second input;

a frequency-determining resistance coupled between the first and second inputs of the driver circuit; and a frequency-determining capacitance coupled between the second input of the driver circuit and the circuit ground node.

16. The electronic ballast of claim 15, further comprising a frequency sweep circuit coupled between the output of the preheat timer comparator and the second input of the driver circuit, wherein the frequency sweep circuit and driver circuit are operable:

(i) in response to the output of the preheat timer comparator changing from a logic "0" to a logic "1", to shift the drive frequency from the preheat frequency to the operating frequency, and then maintain the drive frequency at the operating frequency for at least as long as the output of the preheat timer comparator remains a logic "1"; and (ii) in response to the output of the preheat timer comparator being a logic "0", to set the drive frequency to the preheat frequency, and then maintain the drive frequency at the preheat frequency for at least as long as the output of the preheat timer comparator remains a logic "0".

17. The electronic ballast of claim 16, wherein the frequency sweep circuit is operable to effectively augment the frequency-determining capacitance in response to a logic "1" being present at the output of the preheat timer comparator.

18. The electronic ballast of claim 17, wherein the frequency sweep circuit comprises:

a sweep switch having a base lead, a collector lead, and an emitter lead, the emitter lead being coupled to the circuit ground node;

a sweep timing resistor coupled between the output of the preheat timer comparator and the base lead of the sweep switch;

a sweep timing capacitor coupled between the base lead of the sweep switch and the circuit ground node; and an augmenting capacitor coupled between the collector lead of the sweep switch and the second input of the driver circuit.

19. The electronic ballast of claim 4, wherein the inverter control circuit further comprises:

a first comparator having an inverting input coupled to the NLD input, a non-inverting input coupled to a fault reference voltage, and an output;

a second comparator having a non-inverting input coupled to the OCD input, an inverting input coupled to the fault reference voltage, and an output;

a protection logic circuit having a plurality of logic inputs and a logic output, wherein the plurality of logic inputs includes a first logic input coupled to the output of the first comparator, a second logic input coupled to the output of the second comparator, a timer reset input, a power-up reset input, and a repeat disable input, wherein the protection logic circuit is operable to provide at its logic output:

(a) a logic "0" in response to a logic "0" being present at all of the logic inputs; and (b) a logic "1" in response to a logic "1" being present at at least one of: (i) the first logic input; (ii) the second logic input; (iii) the power-up reset input; and (iv) the repeat disable input;

a preheat timing circuit, comprising:

a DC current source coupled between the DC supply input and a second node;

a timing capacitor coupled between the second node and the circuit ground node; and a discharge switch coupled in parallel with the timing capacitor and having a control lead coupled to the logic output of the protection logic circuit;

a preheat timer comparator having a non-inverting input coupled to the second node, an inverting input coupled to a preheat timing reference voltage, and an output;

an ignition timer comparator having a non-inverting input coupled to the second node, an inverting input coupled to an ignition timing reference voltage, and an output;

a preheat reset comparator having a non-inverting input coupled to the second node, an inverting input coupled to a timer reset reference voltage, and an output coupled to the timer reset input of the protection logic circuit;

a power-up reset circuit coupled between the DC supply input and the power-up reset input of the protection logic circuit, and operable to provide a momentary logic "1" at the power-up reset input following application of power to the ballast;

a counter circuit, comprising a clock input coupled to the output of the preheat timer comparator, a first reset input coupled to the output of the ignition timer comparator, a second reset input coupled to the output of the first comparator, a third reset input coupled to the power-up reset circuit, and a counter output coupled to the repeat disable input of the protection logic circuit, wherein the counter circuit has a count and is operable to:

(a) initialize the count in response to a logic "1" being applied to at least one of the first, second, and third reset inputs;

(b) increment the count by one in response to the output of the preheat timing comparator changing from a logic "0" to a logic "1";

(c) provide a logic "0" at the counter output in response to the count being less than a predetermined count limit; and (d) provide a logic "1" at the counter output in response to the count reaching the predetermined count limit;

a driver circuit, comprising a first drive output coupled to the first inverter switch, a second drive output coupled to the second inverter switch, a reference output coupled to the inverter output terminal, a first input, and a second input;

a frequency-determining resistance coupled between the first and second inputs;

a frequency-determining capacitance coupled between the second input and the circuit ground node; and a frequency sweep circuit coupled between the output of the preheat timer comparator and the second input of the driver circuit, and operable to effectively augment the frequency-determining capacitance of the inverter driver circuit in response to a logic "1" being present at the output of the preheat timer comparator.

20. The electronic ballast of claim 19, wherein the inverter control circuit is implemented as a single integrated circuit.

21. The electronic ballast of claim 1, wherein:

the plurality of output wires comprises first, second, third, and fourth output wires, wherein the first output wire is coupleable to the second output wire through a first filament of the lamp, and the third output wire is coupleable to the fourth output wire through a second filament of the lamp; and the resonant output circuit further comprises:

a resonant inductor coupled between the inverter output terminal and the first output wire;

a resonant capacitor coupled between the first and fourth output wires;

a DC blocking capacitor coupled between the fourth output wire and a circuit ground node;

a filament path resistor coupled between the second and third output wires;

a first filament heating circuit coupled between the first and second output wires; and a second filament heating circuit coupled between the third and fourth output wires.

22. The electronic ballast of claim 21, wherein:

the first filament heating circuit comprises a series combination of a first inductor and a first blocking element;

the second filament heating circuit comprises a series combination of a second inductor and a second blocking element; and wherein the first and second inductors are magnetically coupled to the resonant inductor.

23. The electronic ballast of claim 21, wherein the no-load detection circuit comprises:

a first resistor coupled between the fourth output wire and a fourth node, wherein the fourth node is coupled to the NLD input of the inverter control circuit; and a second resistor coupled between the fourth node and the circuit ground node.

24. The electronic ballast of claim 21, wherein the overcurrent detection circuit comprises:

a current-sensing resistor coupled between the first node and the circuit ground node;

a third resistor coupled between the first node and a fifth node, wherein the fifth node is coupled to the OCD input of the inverter control circuit; and a first capacitor coupled between the fifth node and the circuit ground node.

25. The electronic ballast of claim 24, wherein:

the inverter control circuit further includes an ignition timing output, wherein the inverter control circuit is operable is to provide a logic "1" at the ignition timing output in response to ignition and normal operation of the lamp within the predetermined ignition period; and the overcurrent detection circuit further comprises:

a fourth resistor coupled between the ignition timing output of the inverter control circuit and a sixth node; and a first diode having an anode coupled to the sixth node and a cathode coupled to the fifth node.

26. An electronic ballast for powering at least two gas discharge lamps, each lamp having a pair of heatable filaments, the ballast comprising:

an inverter, comprising:

first and second input terminals for receiving a source of input power, wherein the second input terminal is coupled to a circuit ground node;

an inverter output terminal;

a first inverter switch coupled between the first input terminal and the inverter output terminal;

a second inverter switch coupled between the inverter output terminal and a first node; and an inverter control circuit coupled to the first and second inverter switches, and operable to commutate the inverter switches at a drive frequency, the inverter control circuit having a plurality of fault detection inputs and a DC supply input for receiving operating power;

a resonant output circuit coupled to the inverter output terminals, the resonant output circuit having a natural resonant frequency and a plurality of output wires coupleable to the lamps;

a lamp fault detection circuit coupled between the first node, at least one of the output wires, and the fault detection inputs of the inverter control circuit, the lamp fault detection circuit being operable to provide fault detection signals to the fault detection inputs to indicate whether or not a lamp fault condition is present; and wherein the inverter control circuit is further operable to provide:

(a) a filament preheating mode wherein the drive frequency is maintained at a preheat frequency for a predetermined preheating period;

(b) a frequency shifting mode wherein the drive frequency is shifted from the preheat frequency to an operating frequency;

(c) a high-power operating mode wherein the drive frequency is maintained at the operating frequency in response to successful ignition and normal operation of all of the lamps within a predetermined ignition period, followed by continued normal operation of all of the lamps after ignition;

(d) a repeating mode wherein the filament preheating and frequency shifting modes are repeated up to a predetermined number of times in response to each of: (i) failure of at least one of the lamps to ignite and operate normally within the predetermined ignition period when all lamp filaments are intact and properly connected to the output wires; and (ii) failure of at least one of the lamps to operate normally after igniting; and (e) a low-power protection mode wherein the drive frequency is set to the preheat frequency in response to each of: (i) at least one of the lamps being disconnected from the ballast; and (ii) at least one of the lamps failing to ignite and operate normally within the predetermined ignition period after the repeating mode has been carried out the predetermined number of times.

27. The electronic ballast of claim 26, wherein:

the fault detection inputs of the inverter control circuit include a no-load detection (NLD) input and an overcurrent detection (OCD) input;

the lamp fault detection circuit comprises:

a no-load detection circuit coupled between at least one of the output wires and the NLD input, wherein the no-load detection circuit is operable to provide at the NLD input:

(a) a logic "1" in response to each of: (i) all lamp filaments being intact and properly connected to the output wires; and (ii) all of the lamps conducting arc current; and (b) a logic "0" in response to each of: (i) removal of at least one lamp; and (ii) at least one lamp filament being open when each of the lamps is not conducting arc current; and an overcurrent detection circuit coupled between the first node and the OCD input, wherein the overcurrent detection circuit is operable to provide at the OCD input:

(a) a logic "0" in response to all of the lamps operating normally when the ballast is in the high-power operating mode;

(b) a logic "1" in response to each of: (i) failure of at least one of the lamps to ignite and operate normally within the predetermined ignition period; and (ii) failure of at least one of the lamps to continue to operate normally after ignition.

28. The electronic ballast of claim 27, wherein the overcurrent detection circuit is further operable to provide a logic "0" at the OCD input during the filament preheating and low-power protection modes, and during at least a portion of the frequency shifting mode.

29. The electronic ballast of claim 27, wherein the inverter control circuit further comprises:

a first comparator having an inverting input coupled to the NLD input, a non-inverting input coupled to a fault reference voltage, and an output;

a second comparator having a non-inverting input coupled to the OCD input, an inverting input coupled to the fault reference voltage, and an output;

a protection logic circuit having a plurality of logic inputs and a logic output, wherein the plurality of logic inputs includes a first logic input coupled to the output of the first comparator, a second logic input coupled to the output of the second comparator, a timer reset input, a power-up reset input, and a repeat disable input, wherein the protection logic circuit is operable to provide at its logic output:

(a) a logic "0" in response to a logic "0" being present at all of the logic inputs; and (b) a logic "1" in response to a logic "1" being present at at least one of: (i) the first logic input; (ii) the second logic input; (iii) the power-up reset input; and (iv) the repeat disable input;

a preheat timing circuit, comprising:

a DC current source coupled between the DC supply input and a second node;

a timing capacitor coupled between the second node and the circuit ground node; and a discharge switch coupled in parallel with the timing capacitor and having a control lead coupled to the logic output of the protection logic circuit;

a preheat timer comparator having a non-inverting input coupled to the second node, an inverting input coupled to a preheat timing reference voltage, and an output;

an ignition timer comparator having a non-inverting input coupled to the second node, an inverting input coupled to an ignition timing reference voltage, and an output;

a preheat reset comparator having a non-inverting input coupled to the second node, an inverting input coupled to a timer reset reference voltage, and an output coupled to the timer reset input of the protection logic circuit;

a power-up reset circuit coupled between the DC supply input and the power-up reset input of the protection logic circuit, and operable to provide a momentary logic "1" at the power-up reset input following application of power to the ballast; and a counter circuit, comprising a clock input coupled to the output of the preheat timer comparator, a first reset input coupled to the output of the ignition timer comparator, a second reset input coupled to the output of the first comparator, a third reset input coupled to the power-up reset circuit, and a counter output coupled to the repeat disable input of the protection logic circuit, wherein the counter circuit has a count and is operable to:

(a) initialize the count in response to a logic "1" being applied to at least one of the first, second, and third reset inputs;

(b) increment the count by one in response to the output of the preheat timing comparator changing from a logic "0" to a logic "1";

(c) provide a logic "0" at the counter output in response to the count being less than a predetermined count limit; and (d) provide a logic "1" at the counter output in response to the count reaching the predetermined count limit.

30. The electronic ballast of claim 29, wherein the inverter control circuit further comprises:

a driver circuit, comprising a first drive output coupled to the first inverter switch, a second drive output coupled to the second inverter switch, a reference output coupled to the inverter output terminal, a first input, and a second input;

a frequency-determining resistance coupled between the first and second inputs;

a frequency-determining capacitance coupled between the second input and the circuit ground node; and a frequency sweep circuit coupled between the output of the preheat timer comparator and the second input of the driver circuit, and operable to effectively augment the frequency-determining capacitance of the inverter driver circuit in response to a logic "1" being present at the output of the preheat timer comparator.

31. An electronic ballast for powering at least two gas discharge lamps, comprising:

an inverter, comprising:

first and second input terminals adapted to receive a source of input power, wherein the second input terminal is coupled to a circuit ground node;

an inverter output terminal;

a first inverter switch coupled between the first input terminal and the inverter output terminal;

a second inverter switch coupled between the inverter output terminal and a first node; and an inverter control circuit comprising a first drive output coupled to the first inverter switch, a second drive output coupled to the second inverter switch, a reference output coupled to the inverter output terminal, a DC supply input, a no-load detect (NLD) input, and an overcurrent detect (OCD) input;

an output circuit, comprising:

a set of output wires comprising first, second, third, fourth, fifth, and sixth output wires adapted to being coupled to at least a first and a second gas discharge lamp, wherein the first output wire is coupleable to the second output wire through a first filament of the first lamp, the third output wire is coupleable to the fourth output wire through a second filament of the first lamp, the second filament of the first lamp is coupleable in parallel with a first filament of the second lamp, and the fifth output wire is coupleable to the sixth output wire through a second filament of the second lamp;

a resonant inductor coupled between the inverter output terminal and the first output wire;

a resonant capacitor coupled between the first and sixth output wires;

a DC blocking capacitor coupled between the sixth output wire and the circuit ground node;

a first filament path resistor coupled between the second and third output wires;

a second filament path resistor coupled between the fourth and fifth output wires;

a first filament heating circuit coupled between the first and second output wires;

a second filament heating circuit coupled between the third and fourth output wires; and a third filament heating circuit coupled between the fifth and sixth output wires;

a no-load detection circuit coupled between the sixth output wire and the NLD input of the inverter control circuit;

an overcurrent detection circuit coupled between the first node and the OCD input of the inverter control circuit; and wherein the inverter control circuit further comprises:

a first comparator having an inverting input coupled to the NLD input, a non-inverting input coupled to a fault reference voltage, and an output;

a second comparator having a non-inverting input coupled to the OCD input, an inverting input coupled to the fault reference voltage, and an output;

a protection logic circuit having a plurality of logic inputs and a logic output, wherein the plurality of logic inputs includes a first logic input coupled to the output of the first comparator, a second logic input coupled to the output of the second comparator, a timer reset input, a power-up reset input, and a repeat disable input;

wherein the protection logic circuit is operable to provide at its logic output:

(a) a logic "0" in response to a logic "0" being present at all of the logic inputs; and (b) a logic "1" in response to a logic "1" being present at at least one of: (i) the first logic input; (ii) the second logic input; (iii) the power-up reset input; and (iv) the repeat disable input;

a preheat timing circuit, comprising:

a DC current source coupled between the DC supply input and a second node;

a timing capacitor coupled between the second node and the circuit ground node, and having a timing capacitor voltage; and a discharge switch coupled in parallel with the timing capacitor and having a control lead coupled to the logic output of the protection logic circuit;

a preheat timer comparator having a non-inverting input coupled to the second node, an inverting input coupled to a preheat timing reference voltage, and an output;

an ignition timer comparator having a non-inverting input coupled to the second node, an inverting input coupled to an ignition timing reference voltage, and an output;

a preheat reset comparator having a non-inverting input coupled to the second node, an inverting input coupled to a timer reset reference voltage, and an output coupled to the timer reset input of the protection logic circuit;

a power-up reset circuit, comprising:

a triggering resistor coupled between the DC supply input and a third node;

a triggering capacitor coupled between the third node and the circuit ground node; and a one-shot circuit coupled between the third node and the power-up reset input of the protection logic circuit, and operable to provide a momentary voltage pulse at the power-up reset input in response to the voltage at the third node reaching a predetermined trigger threshold following application of power to the ballast;

a counter circuit, comprising:

a clock input coupled to the output of the preheat timer comparator;

a first reset input coupled to the output of the ignition timer comparator;

a second reset input coupled to the output of the First comparator;

a third reset input coupled to the pulse output of the power-up reset circuit; and a counter output coupled to the repeat disable input of the protection logic circuit;

a driver circuit coupled to the first and second drive outputs and the reference output of the inverter control circuit, and operable to provide complementary switching of the first and second inverter switches at the drive frequency, the driver circuit including a first input and a second input;

a frequency-determining resistance coupled between the first and second inputs of the driver circuit;

a frequency-determining capacitance coupled between the second input of the driver circuit and the circuit ground node; and a frequency sweep circuit coupled between the output of the preheat timer comparator and the second input of the driver circuit, and operable to effectively augment the frequency-determining capacitance of the inverter driver circuit in response to a logic "1" being present at the output of the preheat timer comparator.

* * * * *